US011414872B2

(12) United States Patent
Lewis et al.

(10) Patent No.: US 11,414,872 B2
(45) Date of Patent: Aug. 16, 2022

(54) ROOFTOP FABRIC DISPENSING APPARATUS

(71) Applicant: Bay Insulation Contracting Inc., Green Bay, WI (US)

(72) Inventors: Carl Eric Lewis, Seminole, FL (US); Ernest Craig Abney, Pierson, FL (US); Mark Alan Gerard, Deland, FL (US); David L Tomchak, Fountain Hills, AZ (US)

(73) Assignee: Bay Insulation Contracting Inc., Green Bay, WI (US)

( * ) Notice: Subject to any disclaimer, the term of this patent is extended or adjusted under 35 U.S.C. 154(b) by 227 days.

(21) Appl. No.: 16/566,637

(22) Filed: Sep. 10, 2019

(65) Prior Publication Data

US 2021/0070575 A1 Mar. 11, 2021

(51) Int. Cl.

| | |
|---|---|
| ***E04D 15/06*** | (2006.01) |
| ***B65H 75/24*** | (2006.01) |
| ***B65H 75/30*** | (2006.01) |
| ***B65H 16/00*** | (2006.01) |

(52) U.S. Cl.

CPC ..... *E04D 15/06* (2013.01); *B65H 16/005* (2013.01); *B65H 75/2484* (2021.05); *B65H 75/30* (2013.01); *B65H 2701/1922* (2013.01)

(58) Field of Classification Search

None

See application file for complete search history.

(56) References Cited

U.S. PATENT DOCUMENTS

| | | | | |
|---|---|---|---|---|
| 3,132,820 A * | 5/1964 | Toll | E04D 15/07 | 242/532.5 |
| 4,234,468 A * | 11/1980 | Dalibor | C09D 133/14 | 524/853 |
| 4,290,842 A * | 9/1981 | Gable | E04D 15/06 | 15/256.51 |
| 4,967,535 A * | 11/1990 | Alderman | E04D 15/06 | 52/746.11 |
| 5,551,203 A * | 9/1996 | Alderman | E04D 13/1618 | 52/404.1 |

(Continued)

OTHER PUBLICATIONS

EHS Today article titled "Understanding OSHA's Fall Protection Standard", https://www.ehstoday.com/print/6667, Apr. 1, 1999, 14 pages.

(Continued)

*Primary Examiner* — William A. Rivera

(74) *Attorney, Agent, or Firm* — Stephen C. Jensen; Davis & Kuelthau, S.C.

(57) ABSTRACT

Machines are disclosed for dispensing a rolled fabric over spaced support beams of a roof and for holding the fabric firmly in place over such beams to protect workers from falling through the gaps between the beams. The machines may include one, some, or all of several different components and features to enhance the system's overall operation and effectiveness. One aspect relates to a hub brake used to help prevent unwinding of the fabric roll in the event of a fall. Another aspect relates to a magnetic brake to help keep the machine from sliding across the support beams in the event of a fall. Another aspect relates to a guide assembly that engages a support beam with a one-directional bearing to also help keep the machine from sliding in the event of a fall.

7 Claims, 13 Drawing Sheets

(56) References Cited

U.S. PATENT DOCUMENTS

| | | | | |
|---|---|---|---|---|
| 6,247,288 | B1 | 6/2001 | Harkins | |
| 6,308,489 | B1 | 10/2001 | Romes | |
| 6,393,797 | B1 | 5/2002 | Romes | |
| 6,595,455 | B2 | 7/2003 | Romes | |
| 6,705,059 | B2 | 3/2004 | Romes | |
| 8,347,932 | B2 * | 1/2013 | Kalwara | E04D 15/04 156/577 |
| 8,528,301 | B1 * | 9/2013 | Robbins | E04D 13/1625 52/748.11 |
| 8,596,415 | B2 | 12/2013 | Pelletier | |
| 10,145,120 | B1 | 12/2018 | Vasquez | |
| 2004/0175256 | A1 * | 9/2004 | Wagner | E04F 21/00 414/10 |

OTHER PUBLICATIONS

U.S. Department of Labor, OSHA, Occupational Safety and Health Administration, "Protecting Roofing Workers" pamphlet, 2015, www.osha.gov, 44 pages.

Silvercote Lamination Purlin Glide FP, Insulation & Leading Edge Fall Prevention System manual, GLST74-002, Sep. 2014, 2014 Silvercote, LLC, Silvercote.com, 16 pages.

* cited by examiner

ROOFTOP FABRIC DISPENSING APPARATUS

FIELD OF THE INVENTION

The present invention relates to systems in which a fabric or other flexible material or sheeting is laid or stretched across support beams of a roof or similar structure, with particular application to fall protection systems used to reduce worker injuries from falling through the open gaps between such support beams, and more particularly to machines that are used to dispense such fabric over the beams from a roll or other supply of sheeting material. The invention also pertains to related methods, systems, and articles.

BACKGROUND OF THE INVENTION

Every day around the world, gravity is responsible for countless injuries to humans from the simple act of falling down. Since the potential energy released in a fall is proportional to the vertical distance fallen, the risk of severe injury increases as the vertical drop increases. Thus it is well understood that persons who work on rooftops and similar elevated construction environments are at an increased risk of serious injuries.

According to the U.S. Occupational Safety and Health Administration (OSHA), the leading cause of work-related injuries and deaths among roofers is falls. Furthermore, working six feet or more above lower levels puts workers at risk of serious injury or death if they should fall. OSHA has developed guidelines and standards pertaining to such working environments.

One known approach for protecting workmen engaged in the construction or repair of a metal roof involves stretching a strong but flexible sheeting across the purlins or other beams of the upper support structure of an unfinished roof. The flexible sheeting, referred to in the industry as fall protection fabric, covers the gaps between the beams so that a falling worker is intercepted and supported by the fabric rather than falling through the gap onto the ground or other objects far below. Several machines for dispensing the fall protection fabric over the beams of a roof have been proposed. See for example U.S. Pat. No. 6,595,455 (Romes), or U.S. Pat. No. 8,596,415 (Pelletier).

SUMMARY OF THE INVENTION

We have developed new types of rooftop fabric dispensing machines or apparatuses that can be used for fall protection or similar applications. In brief, the disclosed machines are designed to receive and hold a wide roll of fabric or sheeting and allow the roll to slowly unwind as the machine is advanced along the otherwise uncovered support beams of a roofing structure, such that the fabric stretches across and covers the gap(s) between the beams. The machine includes several features or mechanisms that cooperate to hold the fabric firmly in place in the event a worker falls onto the fabric, e.g. by preventing the fabric roll from unwinding, and by preventing the machine from sliding backwards along the beams toward the fallen worker. The reader will understand that various combinations of the disclosed features can be used to create new families of fabric dispensing machines.

Machines are thus disclosed for dispensing a rolled fabric over spaced support beams of a roof and for holding the fabric firmly in place over such beams to protect workers from falling through the gaps between the beams. The machines may include one, some, or all of several different components and features to enhance the system's overall operation and effectiveness. One aspect relates to a hub brake used to help prevent unwinding of the fabric roll in the event of a fall. Another aspect relates to a magnetic brake to help keep the machine from sliding across the support beams in the event of a fall. Another aspect relates to a guide assembly that engages a support beam with a one-directional bearing to also help keep the machine from sliding in the event of a fall.

Thus, an apparatus for dispensing a rolled fabric over spaced support beams on a rooftop may include a frame, a first and second hub configured to receive a roll of the rolled fabric, and a guide assembly. The guide assembly may be attached to the frame, and may include a first and second bearing disposed beneath the frame and configured to engage opposite sides of a given support beam, the first and second bearings each having a central axis of rotation. Furthermore, the guide assembly may have an engaged position, in which the first and second bearings are configured to engage opposite sides of a given support beam to guide movement of the apparatus along the support beam, and a disengaged position in which at least one of the first and second bearings is configured to not engage the support beam. Alternatively or additionally, the guide assembly may be configured to allow linear motion of the frame along the given support beam in a first direction but resist linear motion of the frame along the given support beam in a second direction opposite to the first direction.

Another apparatus for dispensing a rolled fabric may include a frame, a first and second hub configured to receive a roll of the rolled fabric, and a magnetic brake assembly. The magnetic brake assembly may be attached to the frame, and may have a magnetic element moveable between a locked position and an unlocked position. In the locked position, the magnetic element may contact a support beam to resist motion of the frame along the support beam. In the unlocked position, the magnetic element may be spaced apart from the support beam to allow motion of the frame along the support beam.

Another apparatus for dispensing a rolled fabric may include a frame, and a first and second hub attached to the frame and configured to receive opposite ends of a roll of the rolled fabric. One of the hubs may be part of a hub brake, the hub brake having a locked position in which the hub resists rotational motion, and an unlocked position in which the hub freely rotates.

Numerous related methods, systems, and articles are also disclosed.

These and other aspects of the present disclosure will be apparent from the detailed description below. In no event, however, should the above summaries be construed as limitations on the claimed subject matter, which subject matter is defined solely by the attached claims, as may be amended during prosecution.

BRIEF DESCRIPTION OF THE DRAWINGS

The inventive articles, systems, and methods are described in further detail with reference to the accompanying drawings, of which.

In the figures, like reference numerals designate like elements.

DETAILED DESCRIPTION OF ILLUSTRATIVE EMBODIMENTS

We have developed new families of rooftop fabric dispensing machines or apparatuses that can be used for fall protection or the like. The disclosed machines are designed to receive and hold a wide roll of fabric and allow the roll to slowly unwind as the machine is advanced along the otherwise uncovered support beams of an unfinished roofing structure, such that the fabric stretches across and covers the gap(s) between the beams. The machines also provide a unique set of features to keep the fabric firmly anchored in place in the event a worker falls onto the fabric.

Figure 1:
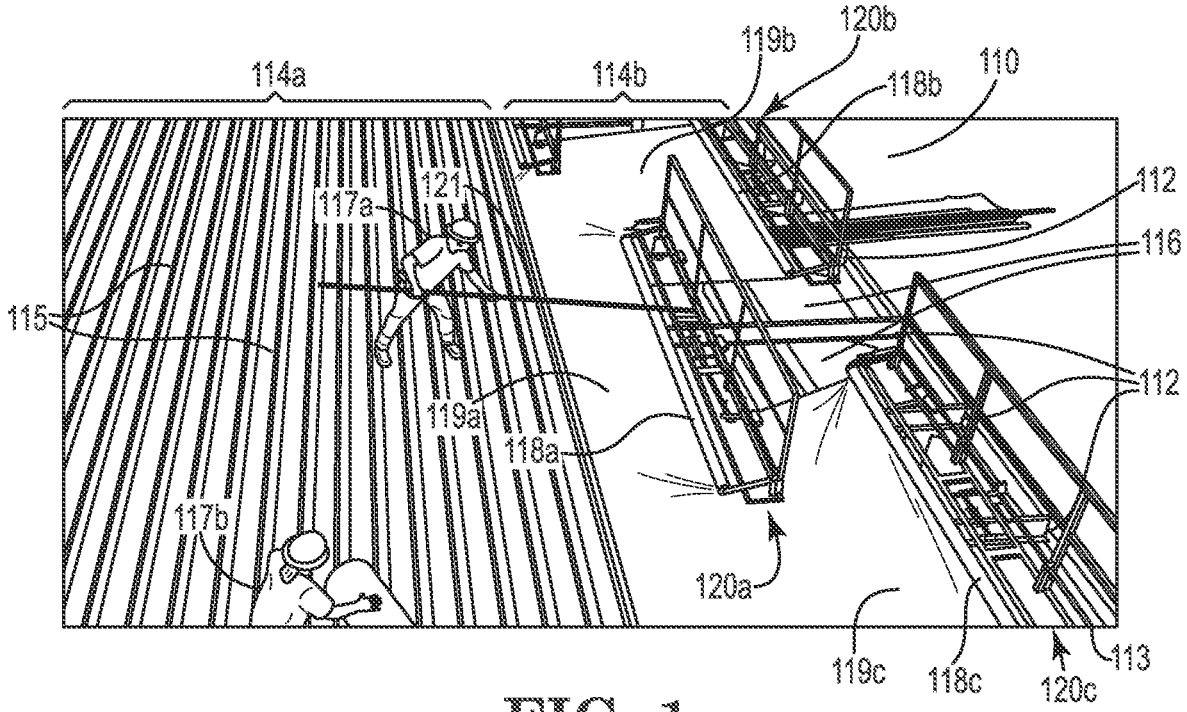
FIG. 1 is a photograph of a rooftop construction site in which workers are using fabric dispensing machines to cover gaps in an unfinished region of the worksite with fall protection fabric to reduce the risk of a worker falling through a gap to the ground below.

A photograph of a rooftop 110 under construction is shown in FIG. 1. On the rooftop 110, workers 117*a*, 117*b* progress in their construction of the roof from left to right from the standpoint of the photograph. The roof may be part of a metal building, or other building or structure. The building may of course have other structural elements, some of which are not shown in FIG. 1, such as footings, columns, brace cables, rafters, eaves, joists, purlins, and other support beams. The roof may be sloped from an uppermost ridge of the roof to an cave at a lowest edge of the roof, but may alternatively be horizontal or unsloped. In the rooftop 110 of FIG. 1, spaced, parallel purlins or support beams 112 can be seen supported at one end by a rafter or cross support beam 113.

The photograph of FIG. 1 depicts a point in time when the roof is partially constructed. The workers apply stiff metal roof panels 115 to the roof by securing them directly or indirectly to the support beams 112 by screws, nails, rivets, or other suitable fasteners. Such roof panels 115 are applied in an orderly side-by-side, end-to-end, or overlapping fashion, e.g., working from left to right from the perspective of the figure. The result is a finished region 114*a*, where roof panels 115 are securely in place atop the support beams 112, and an unfinished region 114*b* which is devoid of roof panels. The roof panels 115 in the finished region 114*a* are sufficiently stiff and secure to support the weight of the workers 117*a*, 117*b* as they walk about on the roof. In the unfinished region 114*b*, gaps 116 between the support beams 112 present falling hazards to the workers as discussed above.

To reduce those hazards, fall protection fabric is stretched out across the support beams 112 to cover the gaps 116. In the depicted embodiment, coverage across the entire width of the unfinished roof is achieved by multiple overlapping pieces or swaths of fabric, including fabric 119*a* from fabric roll 118*a*, fabric 119*b* from fabric roll 118*b*, and fabric 119*c* from fabric roll 118*c*. The separate fabric rolls are held by three separate fabric dispensing apparatuses 120*a*, 120*b*, 120*c*. Each fabric roll and its corresponding dispensing apparatus has a width or transverse dimension of about 2.5 times the beam-to-beam 112 spacing, such that the unrolled fabric drapes across three such support beams 112 with excess fabric left over on both sides of the outermost beams. In alternative embodiments, the beam-to-beam spacing may be shorter or longer, or the transverse dimension of the fabric roll or fabric dispensing apparatus may be shorter or longer, or both, such that the unrolled fabric may drape across only two adjacent support beams, or across four support beams, or five or more support beams, and so forth. Stated differently, the fabric roll or its corresponding dispensing apparatus, or both, may have a width or transverse dimension equal to a factor F times the beam-to-beam spacing, and F may be between 1 and 2, or between 2 and 3, or between 3 and 4, or between 4 and 5, for example. In conventional metal buildings, the beam-to-beam spacing of purlins may typically be 2.5, 3, 4, or 5 feet.

In the particular arrangement shown in FIG. 1, the fabric dispensing machines are staggered so that a worker may advance (push forward) one such machine at a time in an efficient manner to achieve full fabric coverage across a wide rooftop. The worker 117*a* is shown advancing (pushing forward) the fabric dispensing apparatus 120*a* with a long pole 121 so the apparatus 120*a* will be closer to apparatuses 120*b*, 120*c*, which were advanced previously. The separate fall protection fabrics 119*a*, 119*b*, 119*c*, etc., acting together, cover substantially all of the gaps 116 at least along a band or margin of the unfinished region 114*b* immediately adjacent the finished region 114*a*, which is where the fall of a worker would be likely to occur. Besides serving a fall protection function, the fabric may also serve as a vapor barrier for the building. Thus, the fabric would typically remain in place as part of the finished roof insulation system.

In order for the fabric to provide effective protection against worker falls, it should have sufficient strength to resist ripping, tearing, breaking, or otherwise failing, and it should also be securely held in place on opposite sides of the fall. With regard to ripping etc., sufficiently strong sheeting material is known and commercially available, see e.g. Skyliner™ fabric available from Skyliner Fabrics Inc. of The Bay Family of Companies. With regard to holding the fabric securely in place on opposite sides of the fall, one end of the fabric—the end farthest from the fabric roll—is firmly secured to the rooftop in the finished region 114*a* by virtue of being sandwiched or pinched between the roof panels 115 and the support beams 112 in that region. The opposite end of the fabric—the end or portion at or near the fabric roll 118*a*—is held securely only to the extent (a) the fabric roll 118*a* is held in a fixed position relative to the dispensing apparatus 120*a*, and is prevented from unwinding, and (b) the dispensing apparatus 120*a* is held in place and prevented from sliding backwards along the support beams 112.

Thus, in a method of providing fall protection on an unfinished rooftop, a continuous length of fabric may be dispensed by unwinding the roll, the continuous length including a first portion and a second portion, where the second portion is between and connects the first portion to the fabric roll. The first portion of the fabric may be secured to the rooftop by sandwiching the first portion of the fabric between the support beams and one or more roof panels. The dispensing apparatus may be positioned on the rooftop such that the second portion of the fabric overlays the support beams in a region devoid of any roof panels. The second portion of the fabric may be held in place at least in part by the disclosed mechanisms that are configured to prevent the roll from unwinding further, and/or to keep the frame of the dispensing apparatus firmly fixed in place on the support beams and to resist sliding along such beams.

Figure 2:
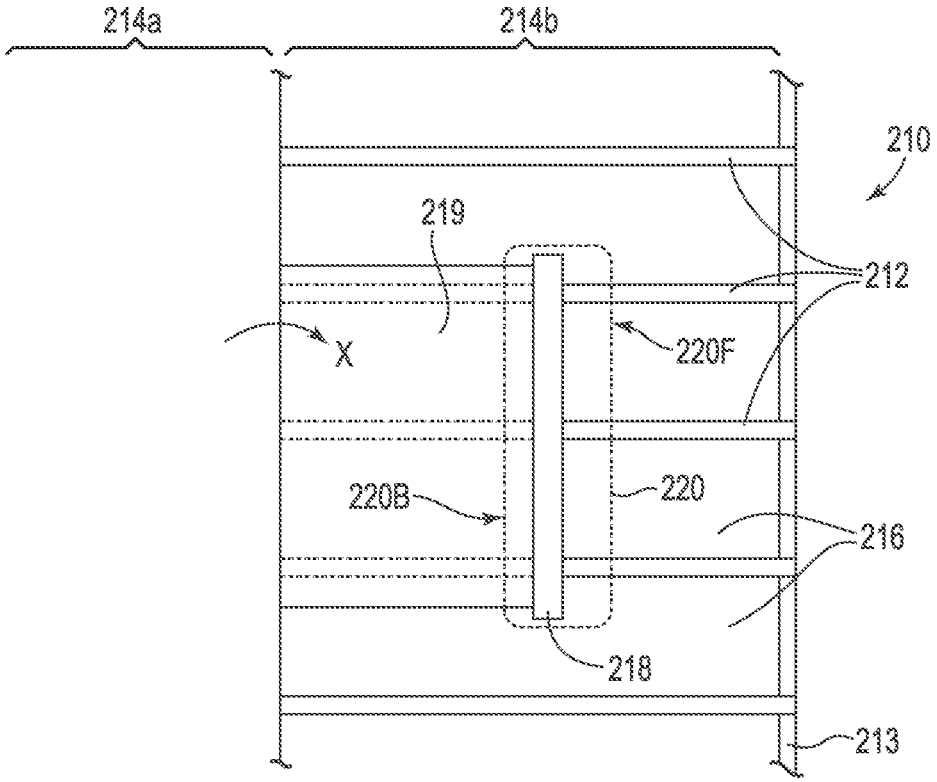
FIG. 2 is a schematic top view of a fabric dispensing apparatus on a rooftop worksite.

A more idealized or simple schematic top view of a rooftop worksite 210, with a single fabric dispensing apparatus 220, is shown in FIG. 2. The rooftop 210 may be similar to that of FIG. 1 insofar as it includes parallel, spaced support beams 212 supported on one end by a cross support beam 213, with gaps 216 between the beams 212, and with a finished region 214*a* over which roof panels have been laid down and secured, and an unfinished region 214*b* where the gaps 216 have not yet been covered by roof panels. We may designate one side 220F of the dispensing apparatus 220 the "front" of the apparatus and an opposite side 220B the "back" of the apparatus, based on the fact that the apparatus is advanced or pushed from left to right (from the perspective of FIG. 2) as work progresses on the roof. (Of course, the work area can be set up in an opposite manner from that shown in FIGS. 1 and 2 such that work proceeds from right to left, and the dispensing apparatus(es) is/are oriented in the opposite direction.) The apparatus 220 holds a fabric roll 218 and allows the roll to unwind as the apparatus advances along the beams 212 so the fabric 219 covers more of the gaps 216. In the finished region 214*a*, the fabric 219 is held firmly by being sandwiched or pinched between the roof panels and the support beams 212.

The risk of a fall is most acute along the edge of the finished region 214*a*, at the boundary between the finished region 214*a* and the unfinished region 214*b*. A worker may lose his balance and fall across the boundary to the unfinished region 214*b*, e.g. at a location indicated by "X". If the fabric 219 were not present, or if it was present but then it broke, tore, or otherwise failed, the worker could fall through the gap 216 and suffer potentially serious injuries upon striking the ground or other objects far below. To avoid this, a suitable sheeting or fabric 219 must be used to keep the worker safe. Furthermore, the fabric 219 must be firmly secured on at least two opposed sides of the fall X to support the weight of the worker. On the side of the fall X occupied by the dispensing apparatus 220, the fabric roll 218 must be held in a fixed position relative to the apparatus 220, and the apparatus 220 must be held in place and prevented from sliding backwards along the support beams 212 toward the location X. Fabric dispensing machines having such capabilities are described in more detail below.

Figure 3A:
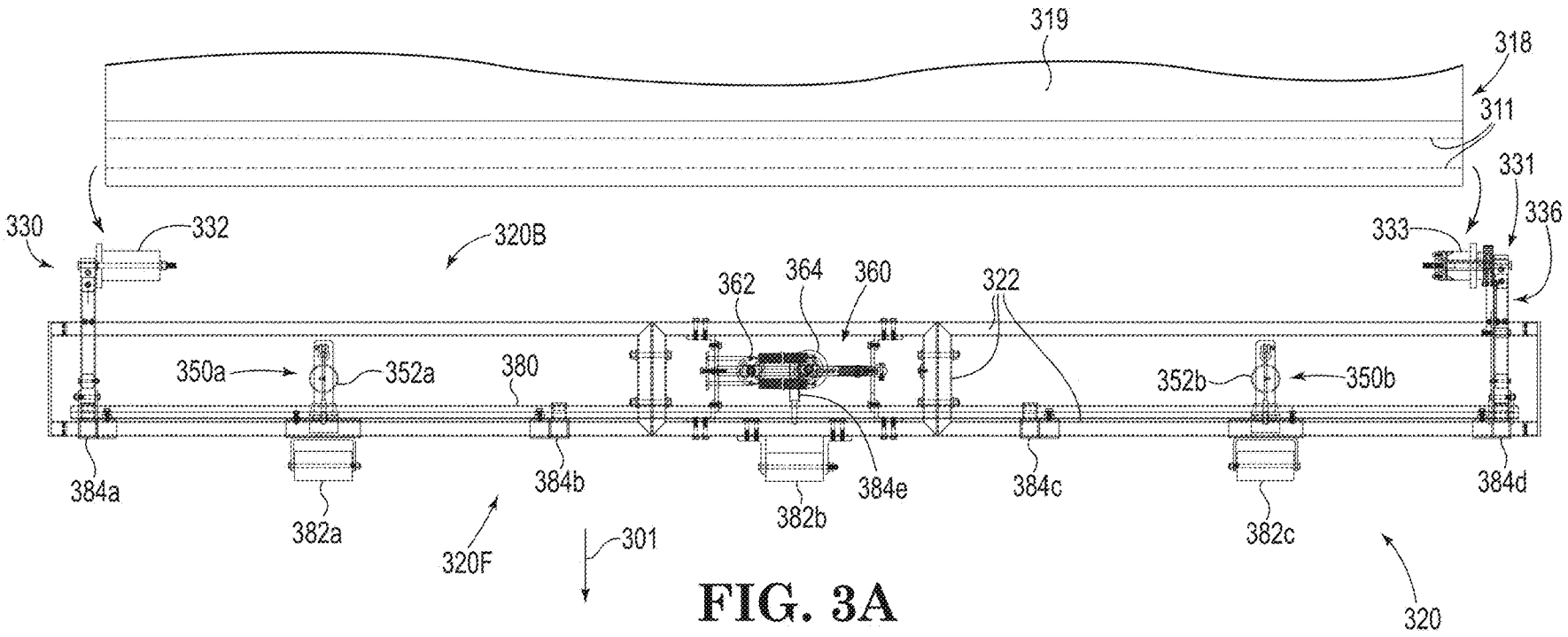
FIG. 3A is a schematic top view of a fabric dispensing apparatus.
Figure 3B:
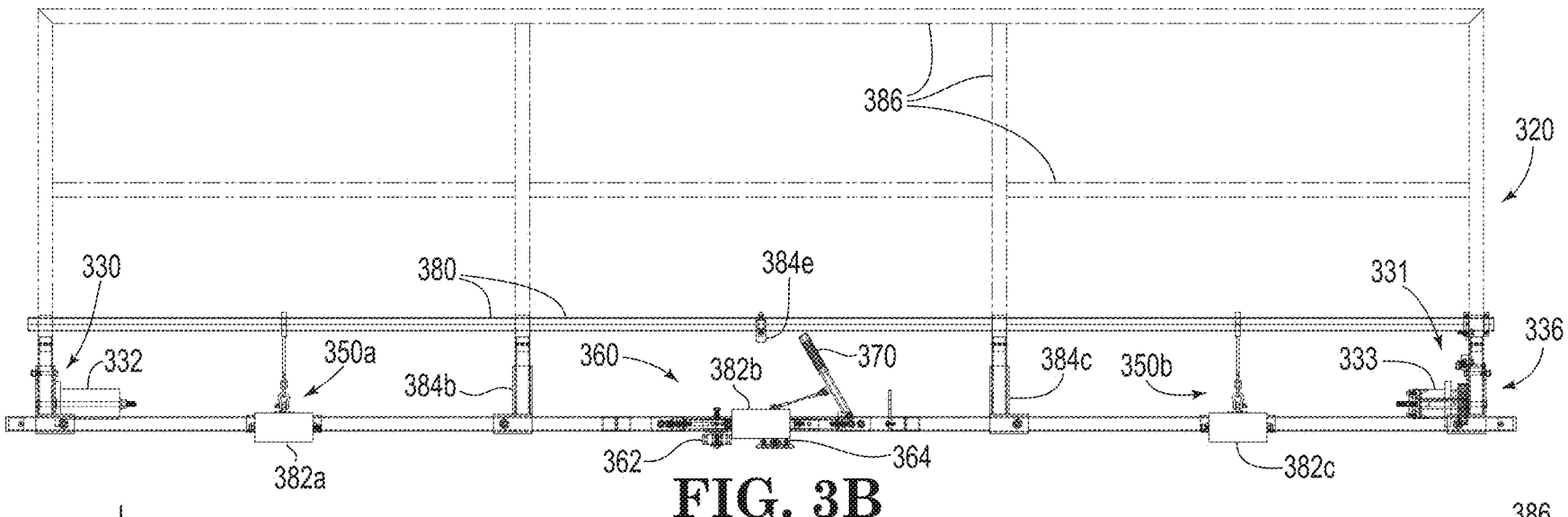
FIG. 3B is a schematic front view thereof.
Figure 3C:
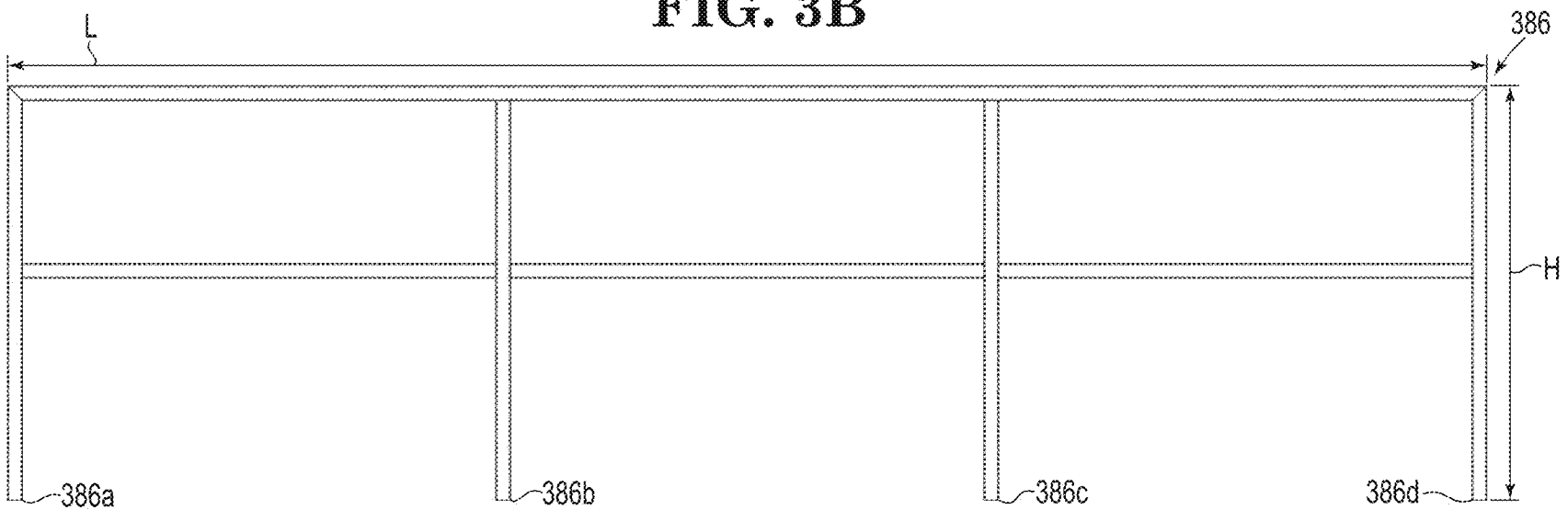
FIG. 3C is a schematic front or rear view of a guardrail for use with the fabric dispensing apparatus of FIGS. 3A, 3B.

Turning then to FIGS. 3A-3C, we see there schematic views of a fabric dispensing apparatus 320 and related components that can be employed on rooftops as part of a fall protection system as described above, and in similar applications. A schematic top view of the apparatus is shown in FIG. 3A, and a schematic front view is shown in FIG. 3B. Like reference numerals in these and other figures designate like elements; therefore, if a given element is labeled with the same reference number in two figures, a single explanation of the element in connection with one figure is equally applicable to the other figure, with no further explanation being needed to avoid pointless repetition.

In the top view of FIG. 3A, the apparatus 320 can be seen to include a frame 322 and hubs 332, 333 attached to opposed ends of the frame and facing inwards towards each other along a common axis. The hubs 332, 333 are sized, spaced, positioned, and otherwise configured to receive a roll 318 of a fall protection fabric 319. The fabric roll 318 may be the same as or similar to the fabric rolls 118*a*, 118*b*, 118*c*, or 218 discussed above. The fabric roll 318 typically comprises a roll core 311 made of cardboard, plastic, or other suitable material, around which the fabric 319 is firmly wound. The core 311 and the fabric roll 318 may have a generally circular shape in cross-section. Fabric 319 may be dispensed from the roll 318 by simply unwinding the roll 318. One end of the core 311 may fit over and engage the hub 332. The opposite end of the core 311 may fit over and engage the hub 333. The fabric roll 318 may be fitted to the dispensing apparatus 320 in this manner while the apparatus is on the ground, after which the combination may be hoisted onto the rooftop worksite. Alternatively, the dispensing apparatus 320 and fabric roll 318 may be hoisted separately to the rooftop, and fitted together there. The hubs 332, 333 may be components of respective hub assemblies 330, 331.

The frame 322 of the apparatus 320 may be constructed from a collection of metal bars, rods, pipes, or the like, fastened together by welding or by discrete mechanical fasteners such as bolts, screws, clamps, or the like. Suitable metals for the frame 322 include but are not limited to aluminum and stainless steel. Other suitable metal or non-metal materials may also be used in the construction of the frame 322 depending on system requirements. Some key functions of the frame are to maintain the hubs 332, 333 in relative alignment, to maintain a firm hold on the fabric roll 318, and to provide a stable mechanical structure that can be alternately (a) moved e.g. by sliding along the support beams of the roof, or (b) held firmly in a substantially fixed position on the support beams. The frame 322 may include various stanchions or other receiving members 384*a*, 384*b*, 384*c*, 384*d* e.g. for connecting a guardrail to the frame. The frame 322 may also include one or more stanchions 384*e* for connecting a pole to the frame such as the pole 121 of FIG. 1, to permit a worker to advance the position of the dispensing apparatus from a distance of several feet or more by pushing the frame forward using the pole engaged in the stanchion 384*e*. The worker may also use the stanchion 384*e*/pole 121 combination to alternatively engage and disengage one or more of the braking mechanisms by simply raising or lowering the pole, as discussed further below.

Figure 6A:
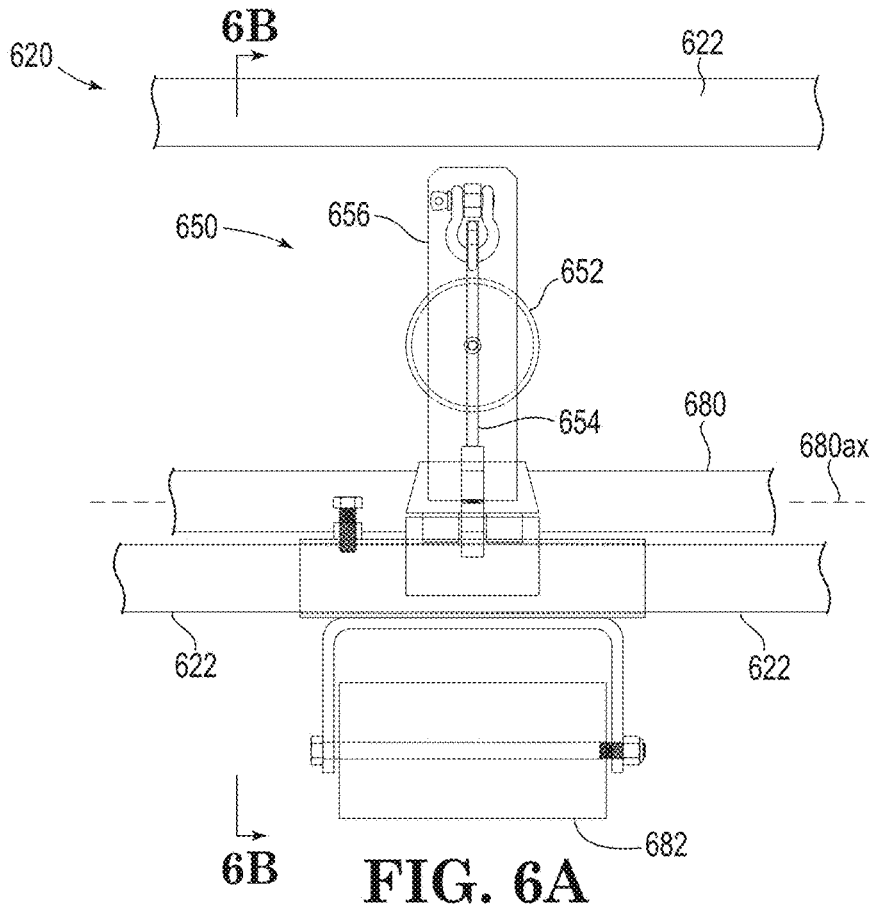
FIG. 6A is a schematic top view of a portion of a fabric dispensing apparatus including a magnetic brake assembly.

The apparatus 320 is designed to advance along the support beams in the direction of arrow 301, such advancement causing the front 320F of the apparatus to move forward and accompanied by a slow unwinding of the fabric roll 318 to dispense the fabric 319 at the back 320B of the advancing apparatus 320. Guide rollers 382*a*, 382*b*, 382*c* may be attached to the frame 322 at positions designed to match the positions of support beams of the roof. By contacting and engaging the top surfaces of such support beams, the rollers 382*a*, 382*b*, 382*c* can help stabilize the apparatus on such beams as a worker pushes and guides the apparatus forward in the direction of arrow 301, and it is in this sense they are referred to as guide rollers. Thus, the guide rollers 382*a*, 382*b*, 382*c* may themselves have no feature or characteristic to help guide the dispensing apparatus other than their respective widths and relative spacing to substantially match the positions of the underlying support beams. For example, each guide roller may have an outer profile, in a cross-sectional plane that contains the guide roller's axis of rotation, that is flat as shown in FIGS. 3A, 3B, and 6A below. Alternatively, a given guide roller may be designed such that its outer profile is curved, concave, or otherwise non-flat to better match the upper surface of the support beam for additional stability or guidance.

The apparatus 320 includes several features or mechanisms that can be used together in a cooperative fashion to hold the fall protection fabric firmly in place in the event of a worker fall, by preventing the fabric roll from unwinding and by preventing the apparatus 320 from sliding backwards along the support beams toward the fallen worker. One such feature is a hub brake 336 to help prevent unwinding of the fabric roll in the event of a fall. Another feature is one or more magnetic brakes 350*a*, 350*b* to help keep the machine from sliding across the support beams in the event of a fall. Another feature is a guide assembly 360 that engages a support beam with a one-directional bearing to also help keep the apparatus 320 from sliding backward in the event of a fall. Embodiments of these features will be explained in further detail below. However, from a high level perspective, the reader should understand that the particular arrangement of these features in FIGS. 3A and 3B is only one of many possible arrangements.

For example, the dispensing apparatus 320 has one hub brake 336 on the right side of the apparatus. Alternatively, the hub brake may be used on the left side of the apparatus, or two hub brakes may be used—one on each side of the apparatus. Still other embodiments may incorporate no hub brakes at all. The dispensing apparatus 320 has one guide assembly 360 in a central portion of the apparatus. Alternatively, the guide assembly may be used in an off-center position, whether towards the left side, or towards the right side, of the apparatus. Still further, multiple guide assemblies may be used, e.g., two total, with one at an off-center left position and one at a symmetrical off-center right position, or three total, where another in the center is also used. Still other embodiments may use no guide assemblies at all. The dispensing apparatus 320 uses two magnetic brakes 350*a*, 350*b*, one at an off-center left position and another at a symmetrical off-center right position. Alternatively, one of these magnetic brakes may be omitted, or a third magnetic brake may be added in a central position in place of the guide assembly 360. Still other embodiments may use no magnetic brakes at all. These are only a few of the many possible variations based on the teachings of the present disclosure.

Some features of the dispensing apparatus 320 can be seen more easily in FIG. 3B than in FIG. 3A. For example, in FIG. 3B we see that the guide assembly 360 includes bearings 362, 364 disposed beneath the frame 322. These bearings are configured to engage opposite sides of a given support beam, as discussed further below. Also seen in FIG. 3B is a levered handle 370 which can be connected to one or both bearings 362, 364 and used to alternately engage and release the guide assembly 360 with the given support beam (see e.g. FIG. 8 below) located beneath the frame 322. A control bar 380 extends across substantially an entire width of the apparatus 320 and frame 322, and can be used to control the functional position of one or more of the disclosed braking devices as discussed further below. Furthermore, the stanchion 384*e* for inserting a pole may be attached to the control bar 380 as shown for additional functionality.

Also easily seen in FIG. 3B is a rigid guardrail 386 which may be formed from a group of interconnected bars, pipes, rods, or the like. As shown, the guardrail 386 may be an optional accessory for removeable attachment to the frame 322. Alternatively, the guardrail 386 may be permanently secured to the frame 322 e.g. by welding. In either case, the guardrail when present may be considered to be part of the frame 322. A front view of the guardrail 386 by itself is shown in FIG. 3C. The ends 386*a*, 386*b*, 386*c*, 386*d* may be spaced and sized to couple to the stanchions 384*a*, 384*b*, 384*c*, 384*d* respectively by a sliding fit, and secured in place by one or more set screws, bolts, or the like. The guardrail 386 may be made of any suitable material, but metals are advantageous for rigidity and strength. Aluminum is particularly advantageous for its lightweight yet strong material characteristics. The guardrail 386 has a length L which may be the same as or similar to the length dimension of the dispensing apparatus 320, and a height H which may be substantially greater than the height of the dispensing apparatus. The length L may be any suitable dimension but in practical embodiments may be in a range from 10 to 20 feet, or from 10 to 15 feet, for example. The height H of the guardrail may be any suitable dimension but in practical embodiments may be in a range from 2 to 5 feet, or from 3 to 4 feet, or at least 42 inches, for example.

The top bar or edge of the guardrail 386 may be 42 inches (1.1 m) plus or minus 3 inches (8 cm) above the walking/working level of the rooftop. In some cases the height of the top edge may exceed 45 inches. The guardrail 386 may also be capable of withstanding a force of at least 200 pounds applied within 2 inches of the top edge, in any outward or downward direction, at any point along the top edge. When the 200 pound test load is applied in a downward direction, the top edge of the guardrail may deflect to a height that is not less than 39 inches (1.0 m) above the walking/working level of the rooftop.

The guardrail 386 may enhance the functionality of the dispensing apparatus by providing a tall physical barrier to help prevent workers from other fall risks besides those discussed above, e.g., fall risks that involve a worker crossing over the dispensing apparatus, as can be appreciated by the view of FIG. 1 above.

With this overview of some exemplary embodiments of the dispensing apparatus, we will now discuss in more detail other aspects of such machines, including features and mechanisms that can be used in a cooperative fashion to hold a fall protection fabric firmly in place in the event of a worker fall, or that can be used individually if desired, or in other combinations and arrangements than those depicted in FIGS. 3A-3B.

Figure 4A:
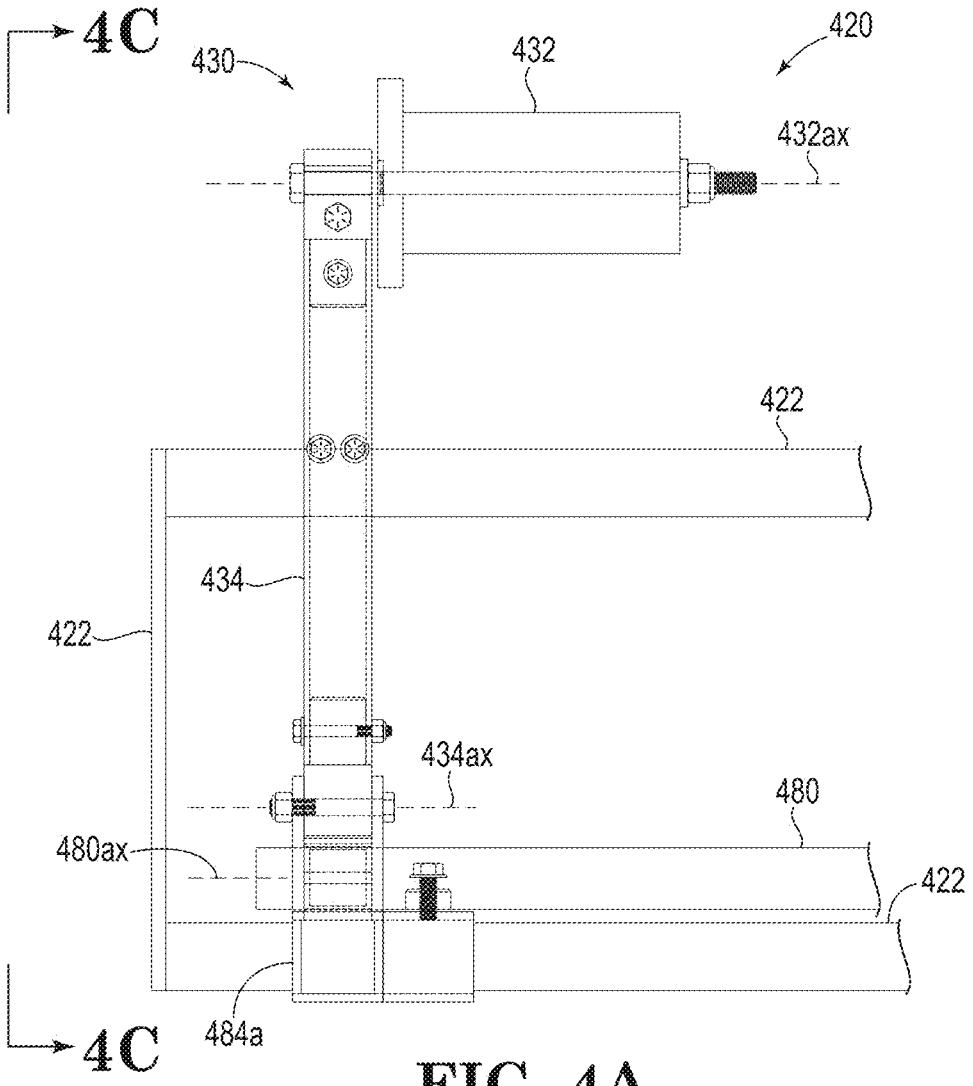
FIG. 4A is a schematic top view of a portion of a fabric dispensing apparatus including a first hub assembly.
Figure 4B:
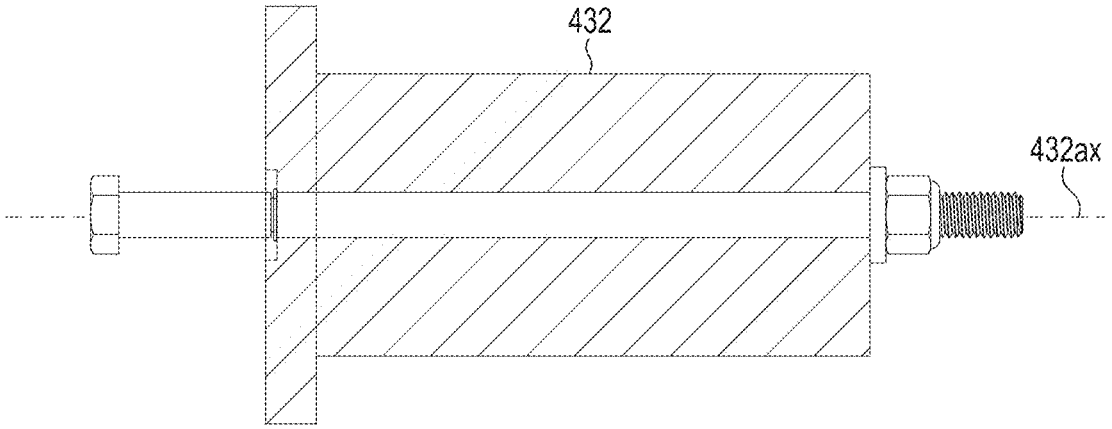
FIG. 4B is a schematic view of a detail of FIG. 4A.
Figure 4C:
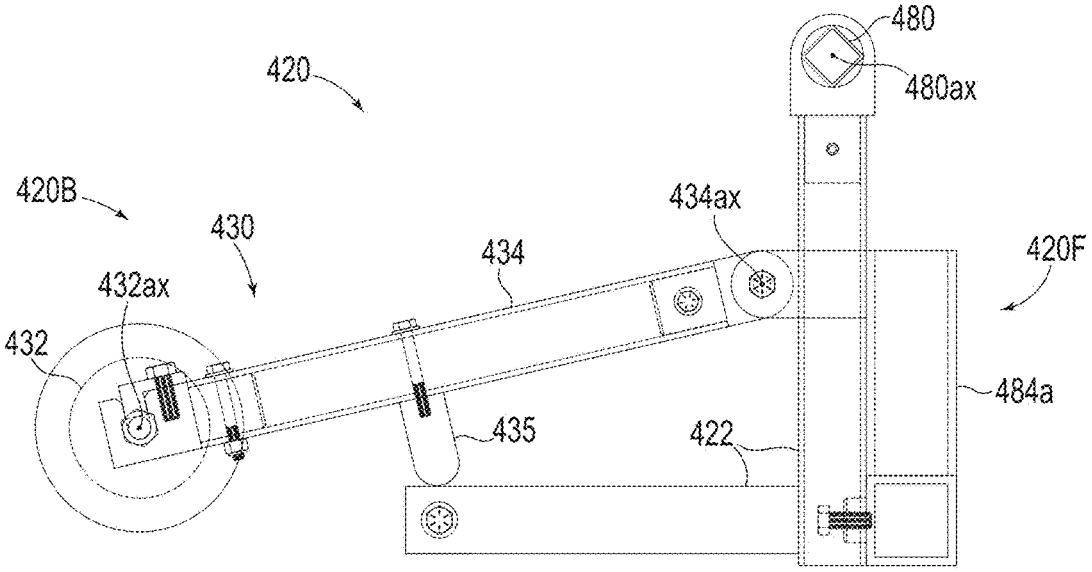
FIG. 4C is a schematic side view of the hub assembly and neighboring portions of the fabric dispensing apparatus of FIG. 4A.

One hub or hub assembly is the subject of FIGS. 4A-4C, which also show other portions of a fabric dispensing apparatus 420. The apparatus 420 has a front 420F and a back 420B, and may be the same as or similar to the previously described apparatus 320. The hub assembly 430 and hub 432 may be the same as or similar to previously described hub assembly 330 and hub 332, respectively.

The hub assembly 430 may include the hub 432 and a pivot arm 434, to which the hub is rotatably attached by an axial through bolt and other connecting components. The hub 432 and through bolt are best shown in FIG. 4B. That figure also shows the centrally located axis of rotation 432*ax* about which the hub 432 can freely turn. The hub 432 has a diameter and an axial length suitable for receiving and firmly holding one end of the fabric roll. More specifically, the plastic or cardboard core of the fabric roll has an inner diameter sized to fit over the outer diameter of the hub 432. The dimensions may be such as to provide a snug slip fit between the core and the hub. Thus, the end of the fabric roll attached to the hub 432 is capable of freely rotating about the axis 432*ax*. The fabric roll as a whole may thus also rotate about that axis unless it is prevented from doing so by a mechanism or force acting on another part of the fabric roll. The hub 432, located at one end of the frame 422, faces inwardly towards a second hub at the opposite end of the frame 422, and the rotational axes of the hubs may be in alignment with each other along a common axis at least when the fabric roll is in place over the hubs at both ends of the roll.

The hub 432 may be made of any suitable material, preferably ultra high molecular weight polyethylene (UHMWPE or UHMW) or other robust plastic or non-plastic materials. The hub 432 rotatably attaches to the pivot arm 434, and together they provide a hub assembly 430. The hub assembly attaches to the frame 422 of the apparatus 420 by a bolt or joint that allows for pivotal motion about a pivot axis 434*ax*. As best shown in FIGS. 4A and 4C, the pivot axis 434*ax* may be parallel to the rotation axis 432*ax* of the hub 432, and parallel to a rotational axis 480*ax* of a control bar 480, which control bar may be the same as or similar to the previously described control bar 380.

As seen in the side view of FIG. 4C, the control bar 480 may have a square cross-sectional shape but may be held and supported by one or more fittings having a circular bore. A sliding fit may be provided between the control bar and the circular bore (or the annular wall of the fitting(s)) to allow the control bar to rotate within the fitting(s) about the axis 480*ax*. Providing the control bar 480 with a square cross-sectional shape makes it easy to attach control arms or other members to it at other positions along the length of the control bar, as described further below. In alternative embodiments, the control bar may have other cross-sectional shapes, such as a circle or disk. The control bar may be solid or hollow, and may be made of any suitable material capable of transmitting the necessary mechanical torques and forces. In an exemplary embodiment the control bar may be a steel tube of square cross-section.

A stanchion 484*a* may be attached to or included as part of the frame 422. The stanchion 484*a* may correspond to stanchion 384*a* above, and as such may be adapted to receive an end of a guardrail such as guardrail 386.

It has already been mentioned that the hub assembly 430 pivotably attaches to the frame 422 by a bolt or joint that allows motion about a pivot axis 434*ax*. Such pivoting motion allows the hub 432 to rise or fall relative to the frame 422 or the support beams of the rooftop as a function of the diameter of the attached fabric roll. A large diameter fabric roll fitted onto the hub 432 and resting atop the support beams of the roof will cause the pivot arm 434 to rotate clockwise relative to its position in FIG. 4C and thus cause the hub 432 to rise relative to its position in FIG. 4C. As fabric is dispensed and the fabric roll decreases in diameter, the pivot arm 434 moves counterclockwise, and the hub's elevation decreases. One or more spacers 435 may be provided as shown on the pivot arm 434 or on the frame 422 or both to prevent the hub from lowering, and to prevent the pivot arm from pivoting, beyond a predetermined point for a fabric roll whose diameter is or becomes less than a predetermined value. In such circumstances, the fabric roll no longer rests on the support beams of the roof, but is fully supported and suspended above such beams by the dispensing apparatus 420, and more specifically by the hub 432 and its opposed hub that connect to opposite ends of the fabric roll.

Another hub 533 and hub assembly 531, which may be located on an opposite end of the dispensing apparatus and frame compared to the hub assembly of FIGS. 4A-4C, are part of a hub brake 536, and these elements and systems are the subject of FIGS. 5A-5M. Some of these figures also show other portions of a fabric dispensing apparatus 520 of which the hub 533, hub assembly 531, and hub brake 536 are a part. The apparatus 520 has a front 520F and a back 520B, and may be the same as or similar to the previously described apparatuses 320, 420. In that regard, the hub assembly 531 and hub 533 may be the same as or similar to previously described hub assembly 331 and hub 333, respectively.

Figure 5A:
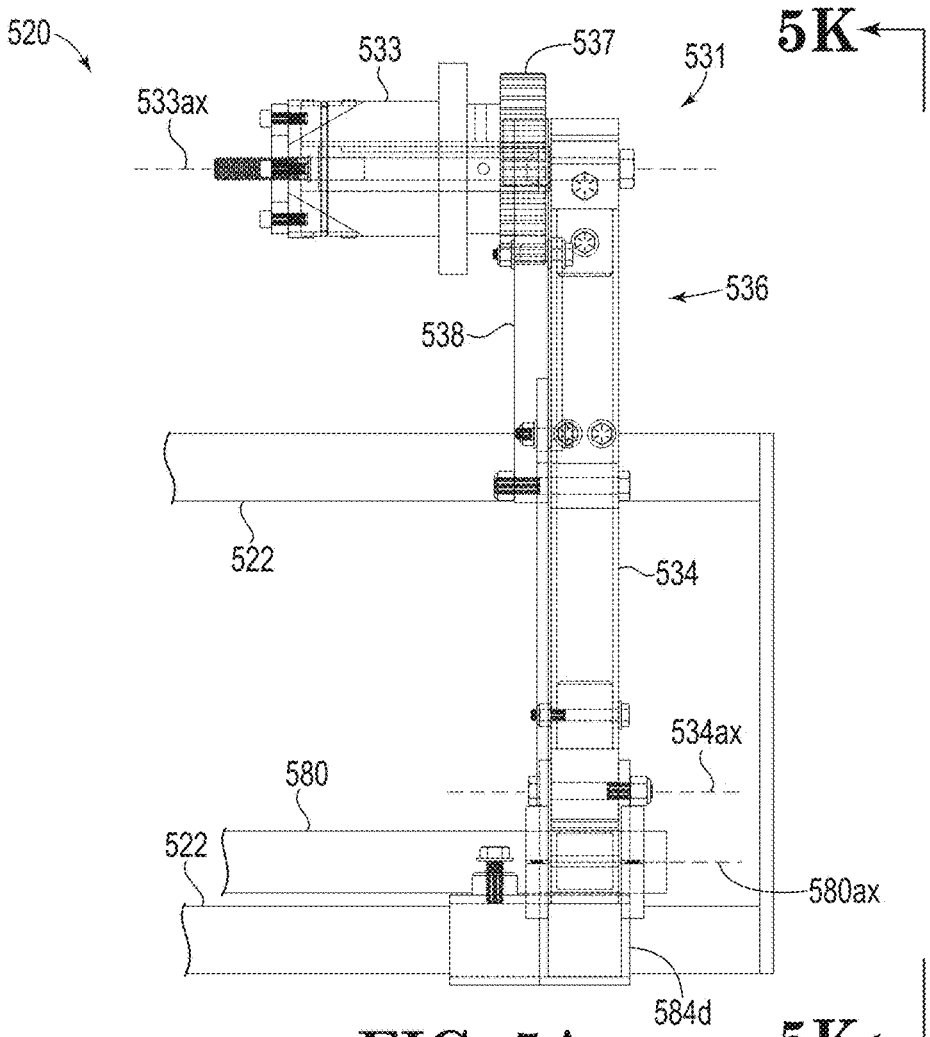
FIG. 5A is a schematic top view of a portion of a fabric dispensing apparatus including a second hub assembly, which includes an expansion hub.
Figure 5B:
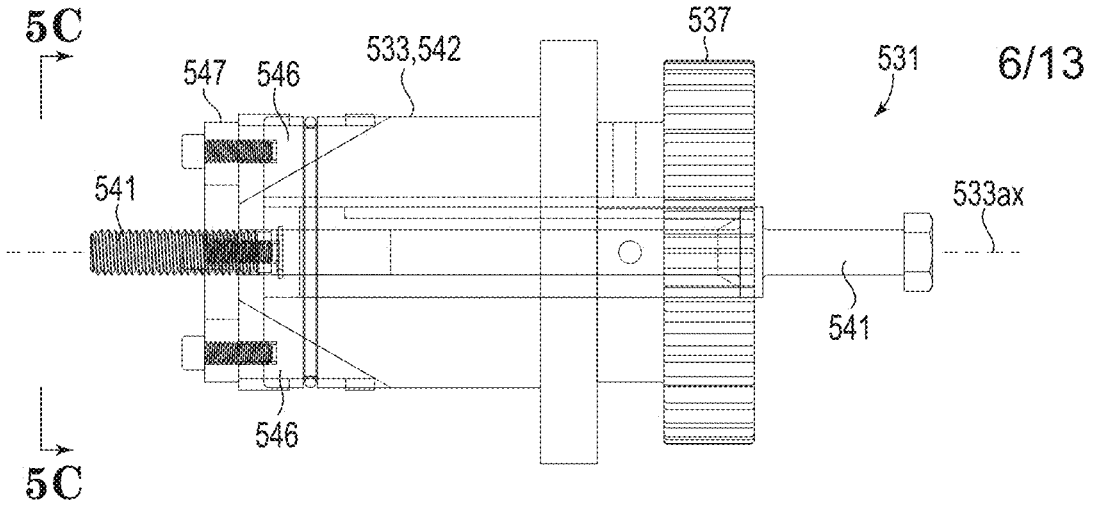
FIG. 5B is a schematic view of the expansion hub included in the hub assembly of FIG. 5A.

The figures in this group are related as follows. FIG. 5A shows a portion of a fabric dispensing apparatus 520 including a hub assembly 531, hub 533, and hub brake 536. The hub 533 has an effective outer diameter that is expandable, and thus the hub is also referred to herein as an expansion hub 533. FIG. 5B shows the expansion hub 533 and some other components of the hub assembly 531. FIGS. 5C-5J show various subcomponents of the expansion hub 533 and hub assembly 531. FIG. 5K is a side or end view taken along line 5K-5K of FIG. 5A, illustrating the hub brake in an unlocked position. FIG. 5L is a side or end view like that of FIG. 5K but where the hub brake has been moved or shifted to a locked position. FIG. 5M is a photograph of a hub brake that was constructed and successfully tested.

The hub assembly 531 may include the expansion hub 533 and a pivot arm 534, to which the expansion hub is rotatably attached by an axial through bolt 541 and other connecting components. The expansion hub 533 and through bolt 541 are best shown in FIG. 5B. That figure also shows the centrally located axis of rotation 533*ax* about which the expansion hub 533 can freely turn, the axis 533*ax* also corresponding to the longitudinal axis of the through bolt 541. The expansion hub 533 has an adjustable effective outer diameter, and an axial length, that are suitable for receiving and firmly holding one end of the fabric roll, namely, the end that is opposite the end held by the first hub 432. The plastic or cardboard core of the fabric roll has an inner diameter sized to fit over the outer diameter of the expansion hub 533 when the hub 533 is adjusted or set to have its effective outer diameter set to a minimum diameter, or at least to a relatively small diameter. The expansion hub 533 is configured to allow an operator to mechanically adjust its effective outer diameter from a small or minimum diameter to a large or maximum diameter. This adjustability allows the end of the fabric roll to easily slip onto the hub 533 when the hub is adjusted to its minimum diameter, while also allowing the hub 533 to grip the core of the fabric roll very tightly—much more tightly than that of the non-adjustable hub 432—when the hub is adjusted to its maximum diameter, or at least to a larger diameter. This adjustment of the diameter does not affect the expansion hub's ability to freely rotate about its central axis 533*ax*. Thus, as long as the expansion hub 533 is allowed to freely rotate, the end of the fabric roll attached to it is also capable of freely rotating about the axis 533*ax* unless it is prevented from doing so by a mechanism or force acting on another part of the fabric roll. The expansion hub 533, located at one end of the frame 522, faces inwardly towards a first hub at the opposite end of the frame 522, and the rotational axes of the hubs may be in alignment with each other along a common axis at least when the fabric roll is in place over the hubs at both ends of the roll.

Before describing the operation of the hub brake 536, we take a closer look at the expansion hub 533 and its manner of operation, and other elements of the hub assembly 531.

Of the numerous ways one can design an expansion hub, a particularly robust and practical embodiment is shown in FIGS. 5A-5J. In this embodiment, adjustment of the hub 533 between a small or minimum diameter and a large or maximum diameter is accomplished by rotating the central through bolt 541 relative to the hub, or more specifically relative to a hub core 542, which can be considered to be a unitary component of the expansion hub 533. This rotation of the through bolt 541, which can be done using a simple wrench applied to the head of the bolt, causes a locking plate 547, which is threaded to the bolt 541 at the opposite end thereof, to move or translate forward or backward along the length of the bolt. This translational motion of the locking plate 547 is in turn converted into radial motion of spikes, teeth, or locking keys 546 due to a sliding action between a ramped surface 546*a* of each locking key 546 and a ramped surface 542*a* of the hub core 542. The radial motion of such locking keys then causes the diameter or effective diameter of the expansion hub 533 to increase or decrease, as explained further below.

The hub core 542 may be made of any suitable material, preferably UHMW referenced above. The hub core is shown by itself in FIGS. 5F and 5G. Those figures reveal that the hub core 542 has a nominal circular cylindrical outer surface which coincides with the end of the lead line for the reference number 542. This nominal cylindrical surface has a diameter which we may refer to as the minimum diameter of the expansion hub 533. At one end of the hub core 542, the nominal cylindrical surface is interrupted in four places by four hub slots 544, each of those slots also defining a recessed, ramped surface 542*a* of the hub core 542 as shown. (The four slots 544 can be replaced with only three such slots, or only two, or even only one, or alternatively, with more than four, e.g., five or six or more, but we have found four slots to be fully acceptable and workable.) Each of the slots 544 is adapted to receive a locking key 546, one of which is shown individually in FIGS. 5I and 5J. Each locking key 546 has a ramped surface 546*a*, which mates with and slides along the ramped surface 542*a* of its corresponding slot 544 during adjustment of the expansion hub 533. On another side of the locking key 546, a ridged end 546*b* is provided. Each locking key 546 also has a threaded hole (not numbered) for receiving a small bolt, the threaded portion of each small bolt passing through one of four elongated through holes of a locking plate 547 as shown in FIGS. 5H and 5B. The through holes in the locking plate 547 are elongated to allow the small bolt to slide radially towards and away from the axis 533*ax* as the ramped surface 546*a* of the locking key 546 slides along the recessed, ramped surface 542*a* of the hub core 542 during adjustment of the expansion hub 533. At one limit of adjustment, the locking keys 546 are all fully recessed within their respective hub slots 544, and the diameter of the expansion hub 533 is a minimum value equal to the outer diameter of the nominal cylindrical surface of the hub core 542. At an opposite limit of adjustment, the locking keys 546, and in particular the ridged ends 546*b* thereof, all protrude from their respective hub slots 544 by substantially equal amounts to the greatest extent allowed by the locking plate 547. At this opposite adjustment limit, the diameter (or effective diameter) of the expansion hub 533 is at a maximum value. In one embodiment, the minimum diameter may be 3.0 inches, and the maximum diameter (or effective diameter) may be in a range from 3.01 to 3.3 inches, or from 3.01 to 3.1 inches. Thus, the amount of adjustment needed between the minimum diameter and the diameter needed to provide a strong grip between the expansion hub and the roll core may be quite small, e.g., the difference may be less than 10% of the minimum diameter.

Figure 5C:
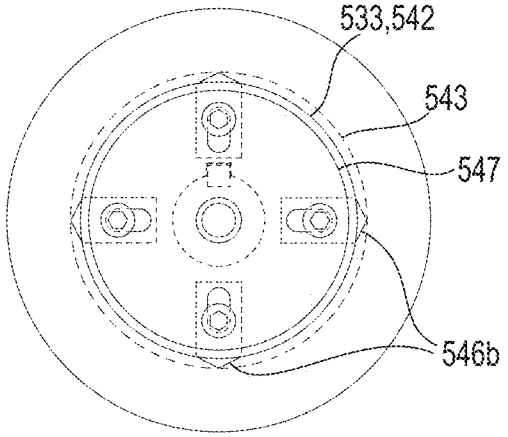
FIGS. 5C-5J are schematic views of other components of the hub assembly and hub of FIG. 5A.
Figure 5D:
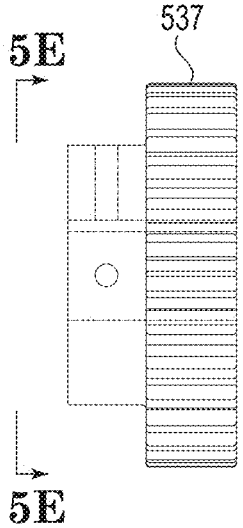
Figure 5E:
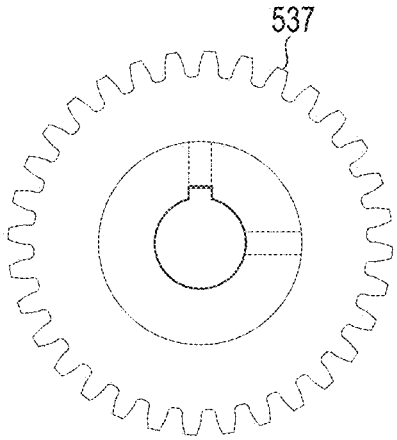
Figure 5F:
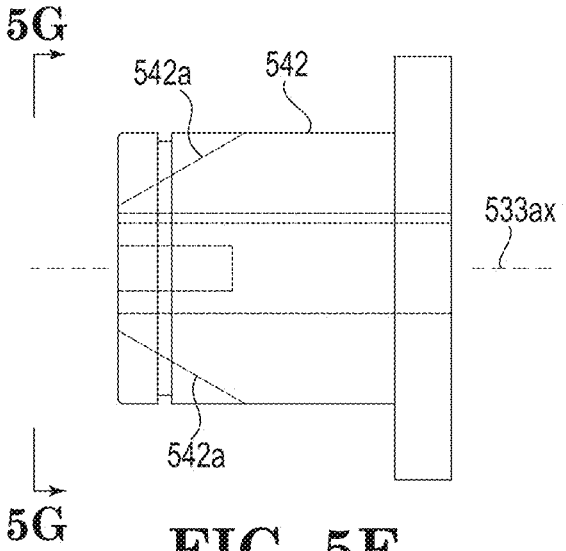
Figure 5G:
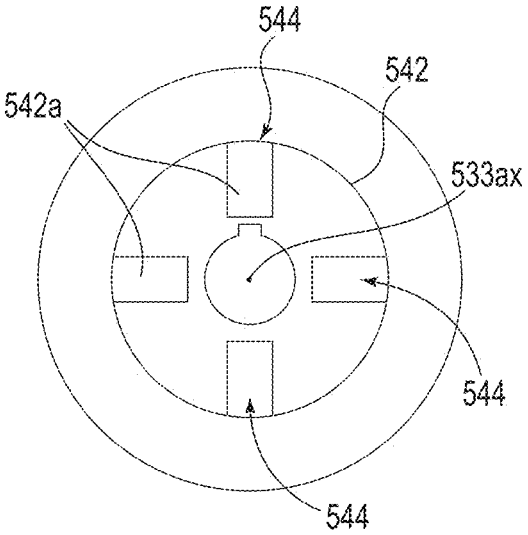
Figure 5H:
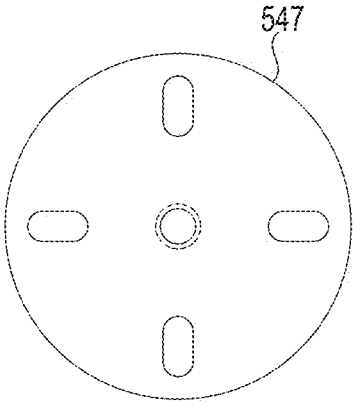
Figure 5I:
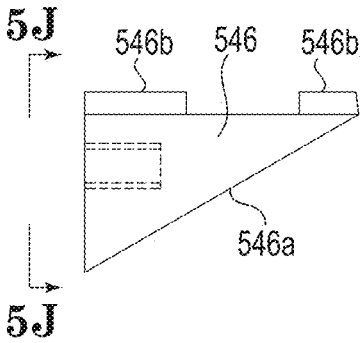
Figure 5J:
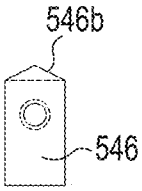
Figure 5K:
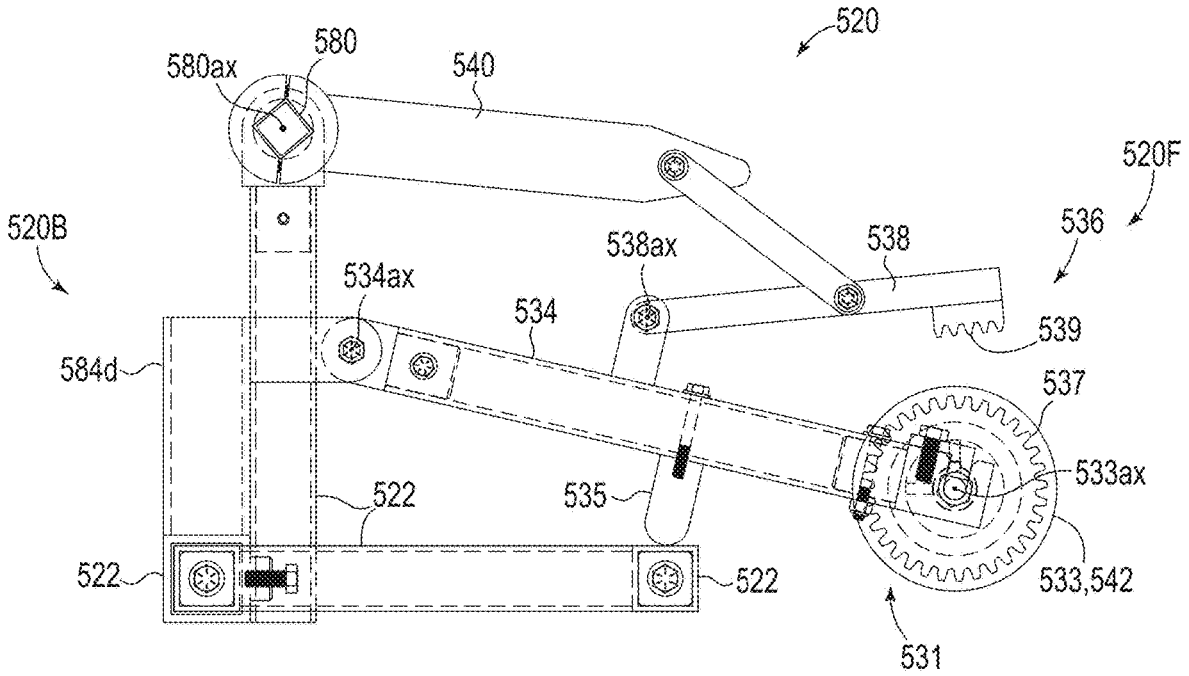
FIG. 5K is a schematic side view of a portion of a fabric dispensing apparatus including a hub brake which in turn includes the hub assembly of FIG. 5A, the hub brake shown in this FIG. 5K in an unlocked position.
Figure 5L:
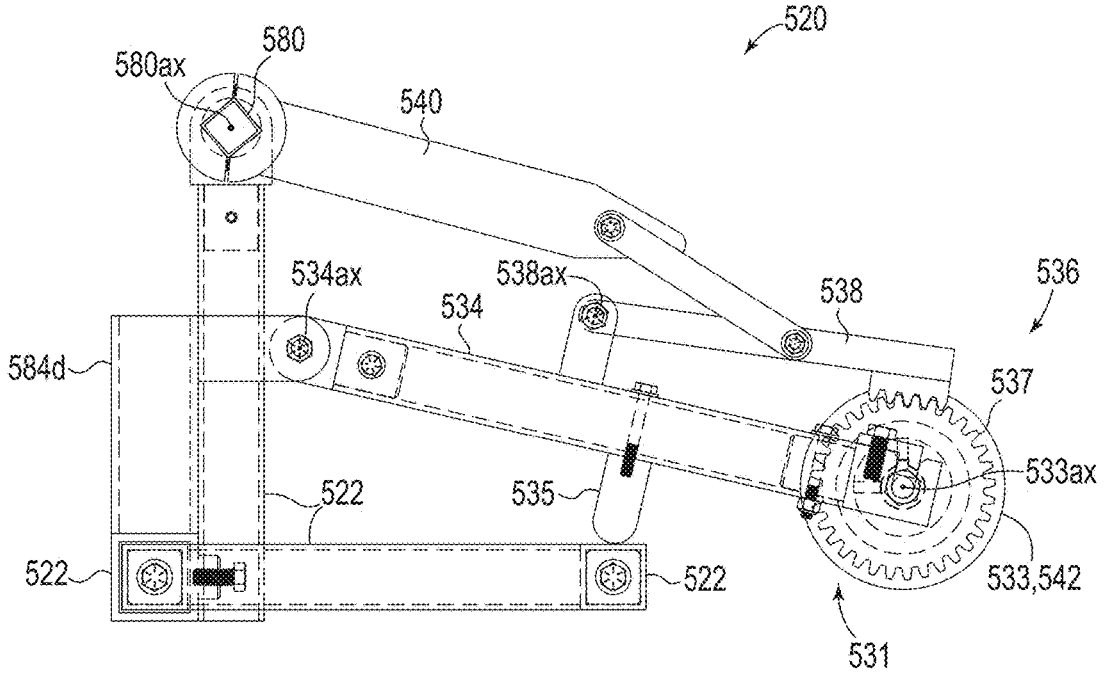
FIG. 5L is similar to FIG. 5K but where the hub brake is in a locked position.
Figure 5M:
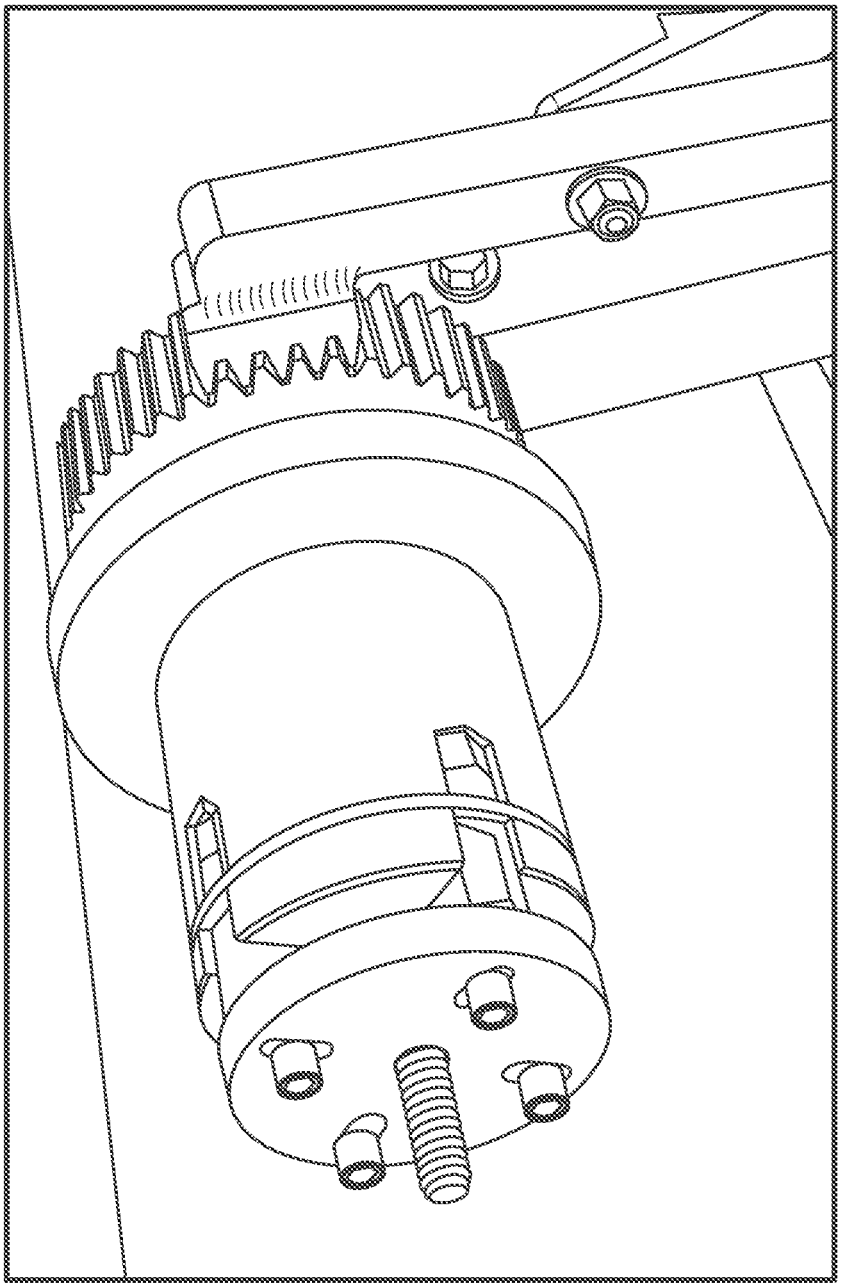
FIG. 5M is a photograph of a hub brake portion of a fabric dispensing apparatus in a locked position.

When the expansion hub 533 is adjusted to its maximum diameter, or at least to a diameter substantially larger than its minimum diameter, the four ridged ends 546*b* of the locking keys 546 protrude from the nominally cylindrical surface of the hub core to define a maximum or expanded diameter as shown by the circle 543 in FIG. 5C. By having a ridged configuration, the ends or ridges of the locking keys 546 grip the inside surface of the core of the fabric roll sharply and tightly along lines of contact that are parallel to each other and to the rotational axis 533*ax* of the hub. This is made possible by orienting each locking key in the hub assembly so that the ridge of the locking key's ridged end extends along an axis that is parallel to the hub axis and the axis 533*ax*. In this way, a strong connection between the expansion hub 533 and the fabric roll is formed to reduce or eliminate rotational slippage, and to prevent unwinding of the fabric roll by means of arresting the motion of the expansion hub 533 without the need for any braking mechanisms of the dispensing apparatus to make contact with the fall protection fabric itself.

To provide a mechanism for alternately arresting or allowing rotational motion of the expansion hub 533, the hub assembly 531 also includes a hub gear 537. The hub gear 537 may be disposed as shown on an end of the hub core 542 opposite the locking plate 547 and locking keys 546. The hub gear 537 may include a central bore that is longitudinally grooved or keyed to match a same or similar central bore in the hub core 542 as shown in the figures. By positioning a suitably dimensioned shaft or key to mate with this longitudinal groove on both pieces, the rotational position of the hub core 542 can be forced to match and follow the rotational position of the hub gear 537, and thus the rotational motion of the expansion hub 533 can be completely controlled by controlling the rotation of the hub gear 537, or vice versa. Such a shaft or key may be integral with, or positioned alongside, an otherwise cylindrical sleeve designed to mate with the keyed central bores of the hub gear 537 and hub core 542, but also allow the through bolt 541 to pass through its center. One way to facilitate rotational control of the hub gear 537 is to provide it with a large diameter portion that is toothed or ridged around its entire circumference as shown best in FIGS. 5D and 5E.

In FIG. 5K, we are able to see additional components and the layout of the hub assembly 531 and the hub brake 536.

The expansion hub 533 and hub gear 537 both attach to the pivot arm 534, and collectively they provide a hub assembly 531. The hub assembly attaches to the frame 522 of the apparatus 520 by a bolt or joint that allows for pivotal motion about a pivot axis 534*ax*. As best shown in FIGS. 5A and 5K, the pivot axis 534*ax* may be parallel to the rotation axis 533*ax* of the hub 533, and parallel to a rotational axis 580*ax* of a control bar 580, which control bar may be the same as or similar to the previously described control bars 380, 480. The control bar 580 may have a square cross-sectional shape as shown in FIG. 5K for reasons discussed above.

A stanchion 584*d* may be attached to or included as part of the frame 522. The stanchion 584*d* may correspond to stanchion 384*d* above, and as such may be adapted to receive an end of a guardrail such as guardrail 386.

The capability of the hub assembly 531 to pivot about the pivot axis 534*ax* allows the expansion hub 533 to rise or fall relative to the frame 522 or the support beams of the rooftop as a function of the diameter of the attached fabric roll. A large diameter fabric roll fitted onto the hub 533 and resting atop the support beams of the roof will cause the pivot arm 534 to rotate counterclockwise relative to its position in FIG. 5K and thus cause the expansion hub 533 to rise relative to its position in FIG. 5K. As fabric is dispensed and the fabric roll decreases in diameter, the pivot arm 534 moves clockwise, and the hub's elevation decreases. One or more spacers 535 may be provided as shown on the pivot arm 534 or on the frame 522 or both to prevent the hub from lowering, and to prevent the pivot arm from pivoting, beyond a predetermined point for a fabric roll whose diameter is or becomes less than a predetermined value. In such circumstances, the fabric roll no longer rests on the support beams of the roof, but is fully supported and suspended above such beams by the dispensing apparatus 520, and more specifically by the hub 533 and its opposed hub that connect to opposite ends of the fabric roll.

The hub brake 536 can be controlled and switched between the unlocked position of FIG. 5K and a locked position by the simple movement or rotation of the control bar 580. This is accomplished using a number of connecting members, including a control arm 540 connected directly to the control bar 580, and a rack arm 538 that connects to the control bar 580 indirectly through another connecting arm. The rack arm 538 has one end anchored to the pivot arm 534 and disposed at a pivot arm axis 538*ax*, and another end that contains a rack 539, the rack 539 having teeth or ridges whose spacing, depth, and shape are configured to mate with and engage the teeth of the hub gear 537. In FIG. 5K, however, the rack 539 is raised above and not engaged with the hub gear 537, hence, in this position the expansion gear 533 is free to rotate about its axis 533*ax*.

The operator of the dispensing apparatus 520 can engage the hub brake and stop any unwinding of the fabric roll, without contacting the fabric itself, by rotating the control bar 580 clockwise to lower the far end of the control arm 540 and thus also lower the end of the rack arm 538 containing the rack 539. Thus lowered, the rack 539 engages the teeth of the hub gear 537 and prevents the hub gear, the expansion hub, and the fabric roll from rotating. This places the hub brake 536 in a locked position as shown in FIG. 5L. The operator can shift the hub brake back again to the unlocked position by rotating the control bar 580 in a counterclockwise direction, e.g. using a pole coupled to the control bar such as by the stanchion 384*e*.

A photograph of a hub brake portion of a fabric dispensing apparatus that was constructed substantially in accordance with FIGS. 5A-5L is provided in FIG. 5M. Components that can be seen in the photograph include an expansion hub, hub core, hub slots, two of the four locking keys (including ridged ends), locking plate, four attachment bolts (smaller bolts) whose threaded portions are inserted into four elongated through holes, the through bolt, the hub gear, rack, rack arm, and pivot arm, all discussed above. A rubber O-ring can also be seen. The O-ring fits into a circumferential slot in the hub core to stabilize the locking keys.

Figure 6B:
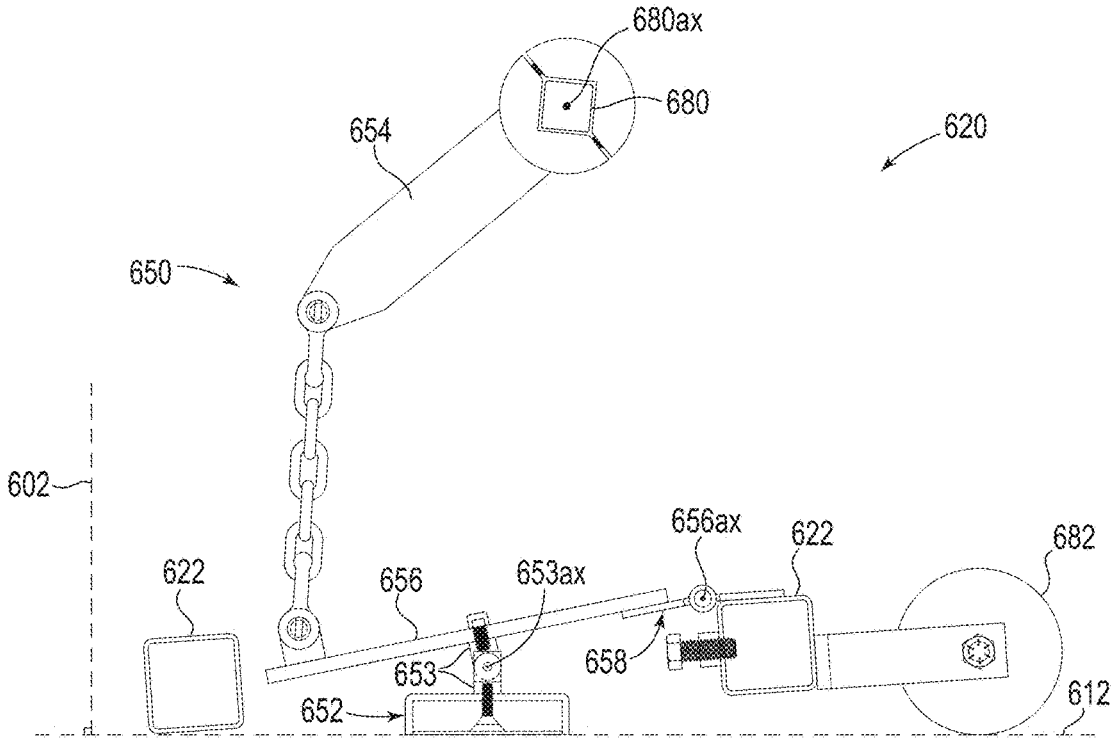
FIG. 6B is a schematic side view of the magnetic brake assembly of FIG. 6A in a locked position.
Figure 6C:
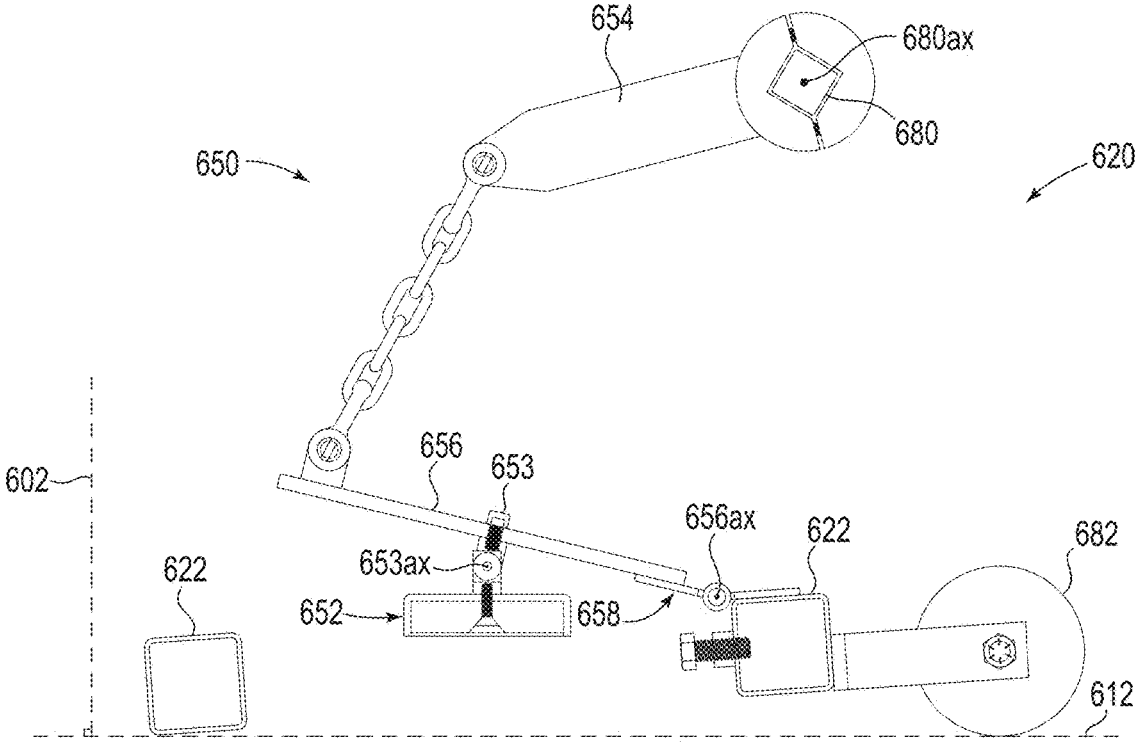
FIG. 6C is similar to FIG. 6B but where the magnetic brake assembly is in an unlocked position.

A magnetic brake assembly 650 useable in the disclosed machines is the subject of FIGS. 6A-6C, which also show other portions of a fabric dispensing apparatus 620. The apparatus 620 may be the same as or similar to the previously described apparatuses 320, 420, and/or 520, but it may also be substantially different.

One or more magnetic brake assemblies 650 may be incorporated into a given fabric dispensing apparatus as a way to help keep the apparatus firmly in place atop the metal purlins or other spaced support beams of the roof without sliding backwards in the event a worker falls onto the fabric as was explained in connection with FIG. 2 above. Of course, the magnetic brake assembly will be able to perform this function as long as the underlying support beam is composed of a suitable metal such as iron or certain types of steel, or any other material to which the magnetic element of the brake assembly 650 will have a strong attraction to. The magnetic brake assembly 650 is preferably designed so the operator can easily switch or shift it between a locked position and an unlocked position. In the locked position, a magnetic element comprising one or more strong magnets contacts the underlying support beam to resist motion of the apparatus along such beam. In the unlocked position, the magnetic element is separated or spaced apart from the underlying support beam to allow motion of the apparatus along the beam.

In exemplary embodiments, the mechanism used by the operator to control the position or state of the magnetic brake assembly 650 shares a common element with other assemblies or subsystems of the dispensing apparatus, such as with one or more other magnetic brake assemblies and one or more hub brakes, so that the operator can engage and disengage multiple such assemblies or subsystems simultaneously with one action or motion. In the embodiments illustrated, the common element is the control bar, see e.g. items 680, 580, 480, 380, optionally in combination with a stanchion 384*e* (or 984*e* discussed below) and a pole 121 (or 921 below).

A top view of the magnetic brake assembly 650 is shown in FIG. 6A, and side views are shown in FIGS. 6B (locked position) and 6C (unlocked position). The assembly 650 may be conveniently mounted between two parallel struts or pieces (members) of the frame 622 as shown, but other mounting configurations are also contemplated. The top view of FIG. 6A shows how the assembly 650 may be mounted to be in substantial alignment with a guide roller 682, the guide roller 682 being one of several guide rollers (see e.g. FIGS. 1 and 3A) located at or near the bottom of the frame 622, each of which contacts a top or upper surface of an underlying support beam of the roofing structure to facilitate sliding, rolling, or moving the fabric dispensing apparatus in a forward direction (see e.g. arrow 301 in FIG. 3A). Thus, when the magnetic element of the magnetic brake assembly 650 contacts a given underlying support beam in the locked position, the guide roller 682 also contacts the same support beam.

The chief operative component of the magnetic brake assembly 650 is the magnetic element 652. This element preferably includes a permanent magnet strong enough to provide substantial resistance to sliding motion when it is in contact with the underlying support beam of the roof. In the embodiment of FIGS. 6A-6C, the permanent magnet is a single disk-shaped magnet with a hole in the center, but other shapes, and other numbers of magnets, e.g. a stack of magnets, can also be used in the magnetic element 652. In some embodiments the permanent magnet may comprise one or more neodymium magnets or other rare earth magnets. The permanent magnet(s), or the magnetic element 652 itself, may be characterized by a pull force of at least several hundred pounds, for example, in a range from 400 to 1,200 pounds, or 450 to 1,200 pounds, or 500 to 1000 pounds, or about 900 pounds.

The magnetic brake assembly 650 also includes components that are arranged to hold and move the magnetic element 652 between a locked position, in which it contacts the underlying support beam, and an unlocked position. In that regard, the assembly 650 may include a magnet control arm 654, a pivot arm 656, a hinge 658, and a jointed connector 653. The connector 653 connects the magnetic element 652 to the pivot arm 656, the connector 653 itself having two portions or elements that pivot relative to each other about an axis 653*ax*. The control arm 654 connects to the pivot arm 656 by a chain, cable, or other strong connecting member. On the other end, the control arm 654 connects to control bar 680, which as discussed above also may connect to other assemblies or subsystems via other control arms, and may be rotationally mounted to the frame about a rotational axis 680*ax*. Movement of the control arm 654 controls movement of the pivot arm 656, to which the magnetic element 652 may be attached. Attachment of the magnetic element 652 to the pivot arm 656 is preferably by another pivot joint, i.e., jointed connector 653, as best seen in FIGS. 6B and 6C. Pivoting about the axis 653*ax* allows gravity to maintain the magnetic element 652 in an upright position with its lower attachment surface oriented horizontally (parallel to the upper surface of the underlying purlin or support beam of the roof) regardless of the orientation of the pivot arm 656. In any case, the pivot arm 656 pivots about an axis 656*ax* by operation of the hinge 658. With the illustrated elements connected in this fashion, the reader will understand how the magnetic element 652 can be lowered to its locked position (FIG. 6B) by rotating the control bar 680 in a counterclockwise direction, and raised to its unlocked position (FIG. 6C) by rotating the control bar 680 in a clockwise direction. For reference purposes in these figures, the upper surface of a horizontally oriented purlin or support beam, atop which the dispensing apparatus 620 rests and slides, is labeled with number 612, and a (perpendicular) vertical axis is labeled 602. In the unlocked position of the magnetic brake assembly 650, the distance or space between the magnetic element 652 and the top surface 612 of the underlying support beam may be a minimum of 3 inches or 10 inches, or in a range from 3 to 8 inches, or 6 to 8 inches.

Figure 7A:
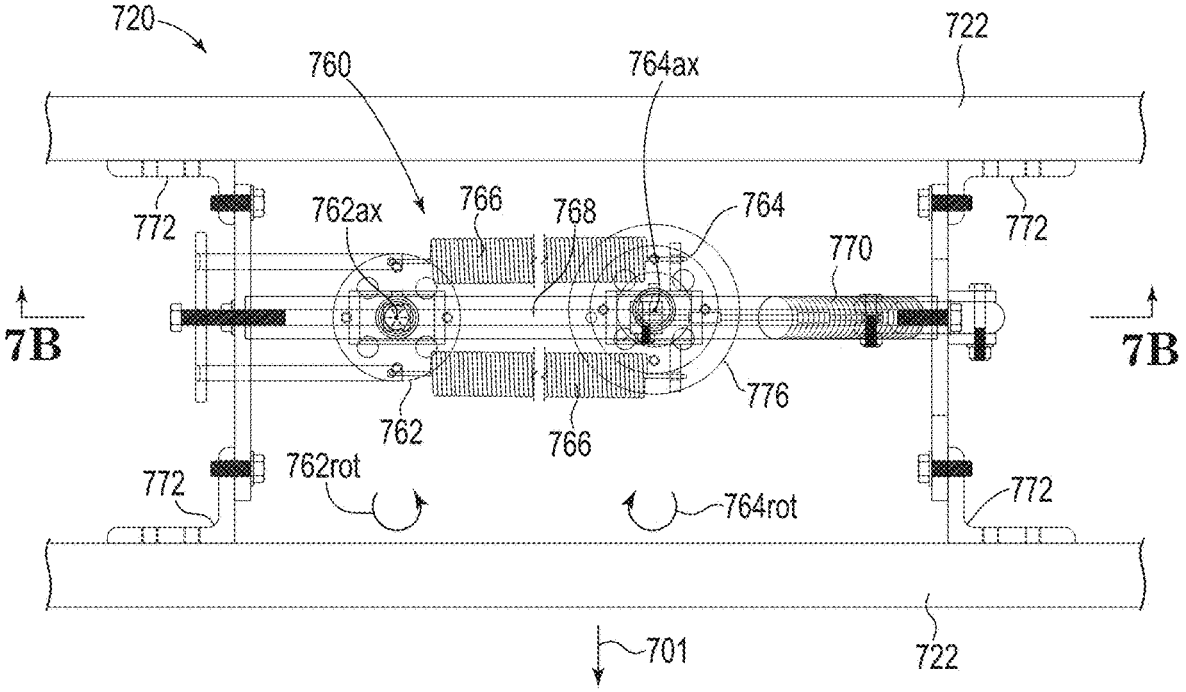
FIG. 7A is a schematic top view of a portion of a fabric dispensing apparatus including a one-directional guide assembly.
Figure 7B:
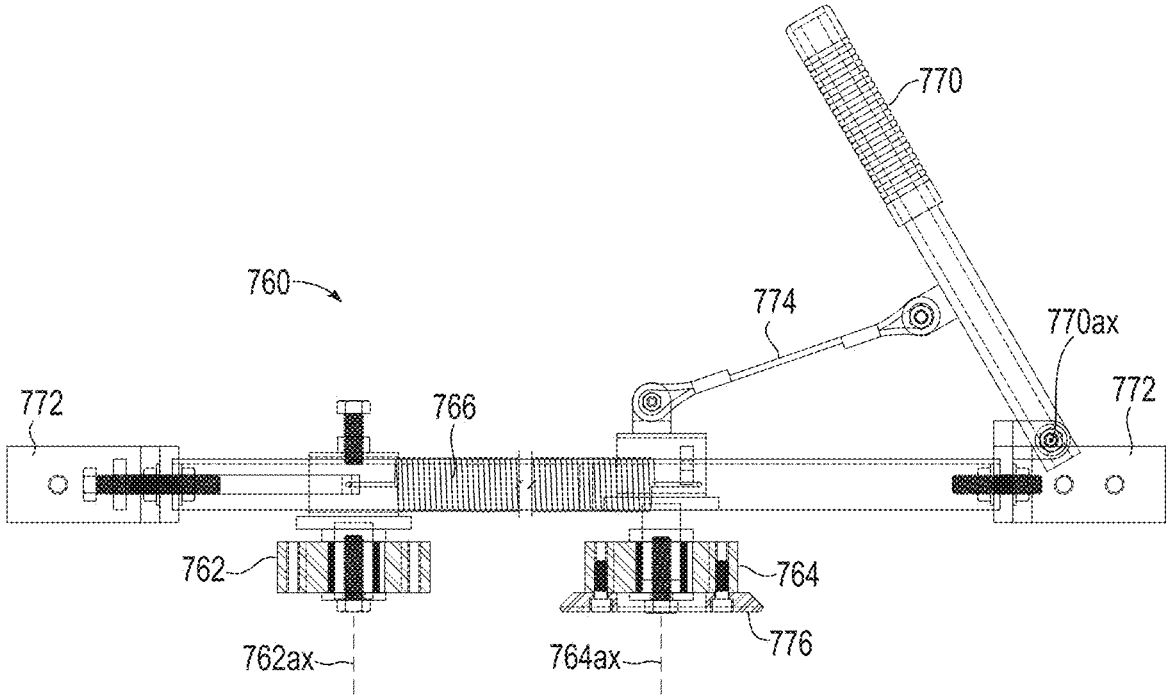
FIG. 7B is a schematic side view of the guide assembly of FIG. 7A, in an engaged position.

Another mechanism that may be included in the disclosed fabric dispensing machines to help keep the apparatus firmly in place atop the support beams of the roof without sliding backwards is a guide assembly, such as the guide assembly 760 of FIGS. 7A and 7B. In preferred embodiments, the guide assembly is designed to alternately engage and disengage an underlying support beam of the roof, and when engaged with such beam, to allow linear motion along the length of the beam in a first direction but prevent or at least resist linear motion in an opposite second direction.

Referring to both figures, the guide assembly 760 is part of a fabric dispensing apparatus 720, and may include first and second bearings 762, 764 mounted beneath the frame of the machine in such a manner as to contact or engage opposite sides of a support beam, as shown best in FIG. 8 below. Each bearing 762, 764 is generally circular in cross-sectional shape and adapted to rotate about an axis 762*ax*, 764*ax* that is perpendicular to, and passes through the center of, such circle. The bearings are preferably composed of a material strong enough to withstand large and repeated compressive and frictional forces between the bearings and the support beam, for example, steel or another hard metal. The guide assembly 760 and bearings 762, 764 may be mounted by means of brackets 772 between two parallel struts or pieces (members) of the frame 722 of the apparatus 720 as shown. The assembly 760 may also include one or more springs such as tension springs 766 to urge the bearings 762, 764 closer together and forcefully against the sides of the underlying support beam to provide a strong grip with minimal slippage. Further to that end, the outer surface of the bearings may include ridges or teeth, as best illustrated in FIG. 8 below.

Figure 8:
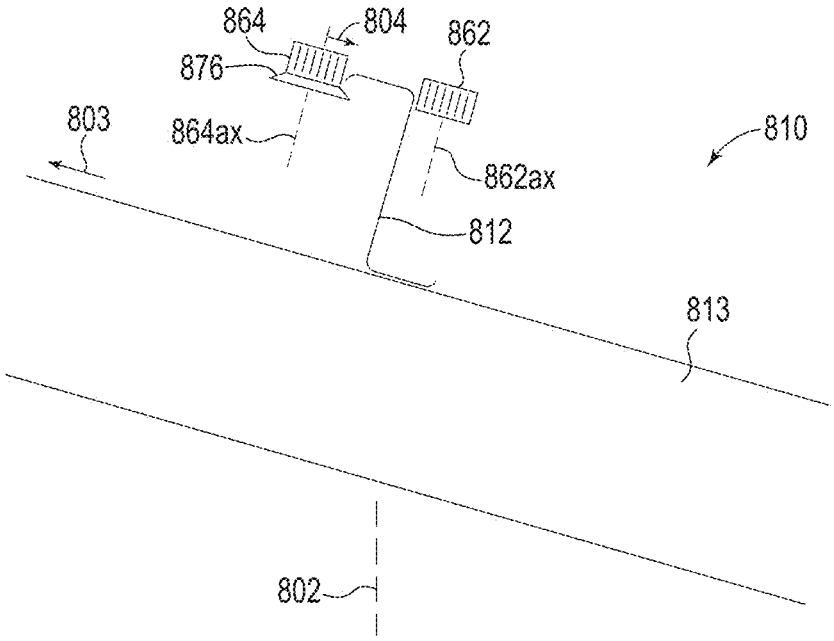
FIG. 8 is a schematic side view of two bearings of a guide assembly in an engaged position on a support beam of a roof.

Also shown in FIG. 8 is the cross-sectional profile of a support beam 812 known in the roofing arts as a purlin. The top portion of the purlin 812 immediately below its uppermost surface is not symmetrical insofar as one side (left in FIG. 8) terminates after a partial bend, and the other side (right in FIG. 8) experiences a 90 degree bend and extends downward to a bottom portion of the purlin. Due to this asymmetry and the truncated nature of one side of the upper portion of the purlin, the bearing 764 intended to engage the truncated side of the purlin may include a roller plate 776 to stabilize the bearing 764 and prevent it from slipping off over the upper edge of the purlin. The roller plate has a larger diameter than the diameter of the working surface of the bearing 764, and may be made of steel or another suitable metal. In order to allow the dispensing apparatus 720 to travel along either one of two opposite directions along the length of the purlin, the roller plate 776 may be made to be interchangeable between the bearing 764 and the bearing 762. In this regard the bearings 764, 762 may be substantially the same except for their direction of allowed rotation. For example, a set of tapped holes may be provided in the bearing 764 as seen in FIG. 7B to allow the roller plate 776 to be screwed or bolted onto it, and the bearing 762 may have a substantially similar set of tapped holes so the roller plate 776 can be readily unscrewed from the bearing 764 and then screwed onto the roller plate 762 to allow the dispensing apparatus to be oriented in the opposite direction atop the purlin.

To allow the bearings 762, 764 to be moved apart for disengagement from the support beam and then back together for engagement, at least one of the bearings should be mounted in such a way as to provide translational movement of the bearing relative to the frame 722, and relative to the other bearing. In the depicted embodiment, although both bearings are rotationally mounted to the frame, the bearing 762 is mounted in a fixed position relative to the frame 722, while the bearing 764 is mounted to the frame by means of an intermediate track bar 768 that can slide back and forth relative to the frame. The tension springs 766 then operate to urge the bearings together by pulling the bearing 764 towards the bearing 762. In a more symmetrical alternative embodiment, both bearings may be mounted to provide translational movement relative to the frame.

The dispensing apparatus may include a handle 770 and lever attached to the track bar 768 by a cable 774 for use by the operator to engage or disengage the guide assembly 760 and bearings. The handle 770 is part of a lever that pivots about an axis 770*ax* to pull, via the cable 774, the bearing 764 away from the bearing 762 to disengage the support beam, or to release the bearing 764 to allow it to slide back towards the bearing 762 to engage the support beam. As shown in FIGS. 7A and 7B, the handle 770 and lever are in an engaged position. Various mechanisms can be used to hold the handle 770 and lever in the disengaged position. For example, a hook may be mounted to the frame 722 in a manner that permits a worker to rotate and/or pivot the hook so that it alternatively captures the lever, to keep the guide assembly 760 in the disengaged position, or releases the lever, to allow the springs 766 to return the guide assembly to its engaged position.

At least one, and preferably both bearings are preferably of the type that are configured to rotate in only one rotational direction. Such one-way bearings are known generally in the mechanical arts and may be of conventional design. In the top view of FIG. 7A, the forward direction of the dispensing apparatus 720 is indicated by arrow 701. This direction, which is parallel to the longitudinal dimension of an underlying support beam, is the direction a worker will push or slide the apparatus in order to dispense additional fabric and cover more open gaps between the support beams. To allow movement of the apparatus 720 in this direction while the guide assembly 760 is engaged, the bearing 762 must be free to turn in the rotational direction 762*rot*, i.e., the counterclockwise direction as seen from FIG. 7A. Similarly, the bearing 764 must be free to turn in the rotational direction 764*rot*, i.e., clockwise. For one-way operation of the guide assembly, the bearing 762 should be made one-directional such that it will not turn, or will resist turning, in the opposite (clockwise) direction, or the bearing 764 should be made one-directional such that it will not turn, or will resist turning, in the opposite (counterclockwise) direction, or both. The greatest resistance to backward motion is provided when both bearings 762, 764 are one-directional.

In a method involving a dispensing apparatus such as apparatus 720, the apparatus may initially be hoisted onto the work area of the unfinished roof. With the guide assembly in a disengaged position, the dispensing apparatus is moved into position atop a plurality of spaced support beams, with the bearings 762, 764 located on opposite sides of an upper portion of a given support beam (e.g. a purlin). The worker then moves the handle 770, e.g. after releasing the rotating/pivoting hook mentioned above, to engage the given support beam with the bearings of the guide assembly. The worker may also manipulate the control bar (e.g. 680, 580, 480, 380) via a pole (e.g. 121, 921) to rotate it such that the hub brake (or hub brakes) and the magnetic brake assemblies (or magnetic brake assembly) are all placed in an unlocked position. The worker may then use the pole to push or advance the fabric dispensing apparatus in a forward direction along the support beams, thus dispensing fabric to cover over open gaps between the beams. The worker may then use the pole to rotate the control bar in the opposite direction to place the hub brake(s) and magnetic brake assembly(ies) in a locked position. If a worker were to then fall onto the fabric covering the gap (stretching between a finished part of the roof and the fabric roll held by the dispensing apparatus), the impulse force and weight of the worker would greatly strain the fabric and tend to pull it forcefully away from the dispensing apparatus. In a successful implementation of the dispensing apparatus, these forces would be counterbalanced by the hub brake(s) to prevent the fabric roll from unwinding, and by the guide assembly(ies) and magnetic brake assembly(ies) to prevent the dispensing apparatus from sliding in the backward direction (opposite the forward direction) towards the fallen worker, thus supporting the worker and protecting him or her from serious injury.

When a fabric dispensing device is provided with a single one-directional guide assembly, and with the guide assembly firmly engaged with a given underlying support beam, a worker falling onto the fabric on a left side or a right side (as seen from a top view) of the given support beam will exert forces that will tend to rotate the frame of the dispensing device counterclockwise or clockwise respectively, as seen from the same top view. Providing the dispensing device with a first magnetic brake assembly positioned over a first support beam on one side of the given support beam, and/or with a second magnetic brake assembly positioned over a second support beam on the opposite side of the given support beam, with such magnetic brake assemblies in their locked positions on their respective support beams at the time the worker so falls, stabilizes the dispensing device by allowing the frame to resist these rotational forces during a fall event.

FIG. 8 has been mentioned previously but will be summarized here for completeness. In this figure, an unfinished rooftop 810 includes spaced support beams 812 (only one is shown for simplicity) with gaps therebetween, the beams 812 being supported by a cross support beam 813 such as a rafter. A roof ridge is not shown but may be located in the direction of arrow 803. The axis 802 is vertical as determined by gravity. A dispensing apparatus as disclosed herein may be disposed atop the support beams 812, the dispensing apparatus including a guide assembly that has bearings 862, 864, which may be the same as or similar to the bearings 762, 764 (respectively) discussed in detail above. The bearings have respective central axes of rotation 862*ax*, 864*ax*, and the bearing 864 may be provided with a roller plate 876. Tension springs or other mechanical elements urge the bearing 864 towards the bearing 862 so that the support beam 812 is squeezed between or forced against the bearings. In this condition, the guide assembly is in an engaged position.

Figure 9A:
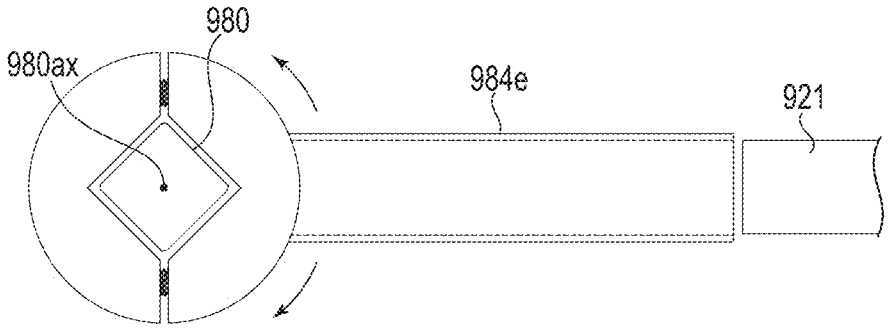
FIG. 9A is a schematic side view of a control bar stanchion for a fabric dispensing apparatus.
Figure 9B:
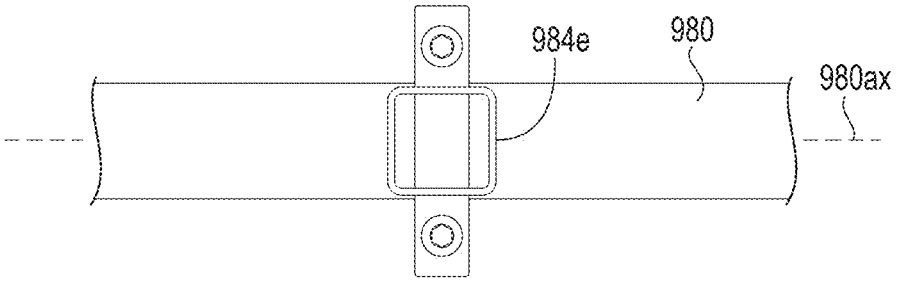
FIG. 9B is a front view of the control bar handle stanchion of FIG. 9A.

Turning finally to FIGS. 9A and 9B, shown there are schematic views of a stanchion 984*e* and related components which may be used in any of the disclosed fabric dispensing machines. The stanchion 984*e* may be used as a control mechanism when connected to a control bar 980 having an axis of rotation 980*ax*. A worker using a rod or pole 921 can manipulate the dispensing apparatus from a distance of several feet or more by inserting the pole 921 into the stanchion 984*e* and using the pole to push the dispensing apparatus forward, i.e., away from the worker, as well as raising or lowering the pole to rotate the control bar 980 in a clockwise or counterclockwise direction as desired to engage or disengage brake assemblies or other assemblies or subsystems of the dispensing apparatus. The stanchion 984*e* may be the same as or similar to stanchion 384*e* discussed above. The control bar 980 may be the same as or similar to any of the control bars 680, 580, 480, or 380 discussed above.

Unless otherwise indicated, all numbers expressing quantities, measured properties, and so forth used in the specification and claims are to be understood as being modified by the term "about". Accordingly, unless indicated to the contrary, the numerical parameters set forth in the specification and claims are approximations that can vary depending on the desired properties sought to be obtained by those skilled in the art utilizing the teachings of the present application. Not to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, to the extent any numerical values are set forth in specific examples described herein, they are reported as precisely as reasonably possible. Any numerical value, however, may well contain errors associated with testing or measurement limitations.

The use of relational terms such as "top", "bottom", "upper", "lower", "above", "below", and the like to describe various embodiments are merely used for convenience to facilitate the description of some embodiments herein. Notwithstanding the use of such terms, the present disclosure should not be interpreted as being limited to any particular orientation or relative position, but rather should be understood to encompass embodiments having any orientations and relative positions, in addition to those described above.

The following is a non-limiting list of items of the present disclosure.

Item 1.1. An apparatus for dispensing a rolled fabric over spaced support beams on a rooftop, comprising:

a frame;

a first and second hub attached to opposite ends of the frame and configured to receive a roll of the rolled fabric; and a guide assembly attached to the frame, the guide assembly including a first and second bearing disposed beneath the frame and configured to engage a given support beam, the first and second bearings each having a central axis of rotation;

wherein the guide assembly has an engaged position in which the first and second bearings are configured to engage opposite sides of the given support beam to guide movement of the apparatus along the given support beam, and a disengaged position in which at least one of the first and second bearings is configured to not engage the given support beam.

Item 1.1a. The apparatus of item 1.1, wherein at least one of the first and second bearings is configured to rotate in only one rotational direction such that when the guide assembly is in the engaged position the guide assembly allows linear motion of the frame along the given support in a first direction but resists linear motion of the frame along the given support beam in a second direction opposite to the first direction.

Item 1.1b. The apparatus of item 1.1a, wherein each of the first and second bearings is configured to rotate in only one rotational direction.

Item 1.1c. The apparatus of item 1.1, wherein the first bearing is rotatably mounted at a fixed position on the frame, and the second bearing is rotatably mounted to a moveable member.

Item 1.1d. The apparatus of item 1.1c, wherein the moveable member is spring loaded relative to the frame.

Item 1.1e. The apparatus of item 1.1d, wherein the guide assembly further includes a lever pivotably attached to the frame and coupled to the moveable member by one or more springs.

Item 1.1f. The apparatus of item 1.1c, wherein the second bearing includes a roller plate attached thereto, the roller plate having a greater diameter than that of the second bearing.

Item 1.1g. The apparatus of item 1.1, wherein the frame includes parallel first and second frame members, and wherein the guide assembly is mounted between the first and second frame members.

Item 1.1h. The apparatus of item 1.1, further comprising:

a first guide roller attached to the frame in substantial alignment with the guide assembly such that the first guide roller contacts a top surface of the given support beam when the guide assembly engages the given support beam.

Item 1.1i. The apparatus of item 1.1h, further comprising:

a second guide roller and a third guide roller attached to the frame at different positions than the first guide roller, the second and third guide rollers configured to contact respective second and third support beams when the first guide roller contacts the given support beam.

Item 1.1j. The apparatus of item 1.1, further comprising:

a first magnetic brake assembly attached to the frame, the first magnetic brake assembly having a first magnetic element moveable between a locked position and an unlocked position.

Item 1.1k. The apparatus of item 1.1, wherein the first hub is part of a hub brake, the hub brake having a locked position in which the first hub resists rotational motion and an unlocked position in which the first hub freely moves.

Item 1.1L. The apparatus of item 1.1k, further comprising:

a first magnetic brake assembly attached to the frame, the first magnetic brake assembly having a first magnetic element moveable between a locked position and an unlocked position; and a control bar attached to the frame;

wherein the control bar is coupled to both the hub brake and the first magnetic brake in such a manner that a motion of the control bar causes the hub brake to shift between the unlocked position and the locked position and the first magnetic element to shift between the unlocked position and the locked position.

Item 1.1m. A method of draping a fall protection fabric over a plurality of spaced support beams on a rooftop to cover gaps between such support beams, the method comprising:

providing a roll of the fabric, the roll having a first end and a second end;

providing the dispensing apparatus of item 1.1;

securing the first end of the roll to the first hub and securing the second end of the roll to the second hub;

dispensing a first portion and a second portion of the fabric by unwinding the roll, the first portion being connected to the roll by the second portion;

securing the first portion of the fabric to the rooftop by sandwiching the first portion of the fabric between the support beams and one or more roof panels;

positioning the dispensing apparatus on the rooftop such that the second portion of the fabric overlays the support beams in a region devoid of any roof panels; and holding the second portion of the fabric in place at least in part by engaging the given support beam with the guide assembly.

Item 1.2 An apparatus for dispensing a rolled fabric over spaced support beams on a rooftop, comprising:

a frame;

a first and second hub attached to the frame and configured to receive opposite ends of a roll of the rolled fabric; and a guide assembly attached to the frame, the guide assembly including a first and second bearing disposed beneath the frame and configured to engage opposite sides of a given support beam, the first and second bearings each having a central axis of rotation;

wherein the guide assembly is configured to allow linear motion of the frame along the given support beam in a first direction but resist linear motion of the frame along the given support beam in a second direction opposite to the first direction.

Item 1.2a The apparatus of item 1.2, wherein at least one of the first and second bearings is configured to rotate in only one rotational direction.

Item 1.2b. The apparatus of item 1.2a, wherein each of the first and second bearings is configured to rotate in only one rotational direction.

Item 1.2c. The apparatus of item 1.2, wherein the guide assembly includes a spring-loaded release mechanism to disengage at least one of the first and second bearings from the given support beam.

Item 1.2d. The apparatus of item 1.2, wherein the first bearing is rotatably mounted at a fixed position on the frame, and the second bearing is rotatably mounted to a moveable member.

Item 1.2e. The apparatus of item 1.2d, wherein the moveable member is spring loaded relative to the frame.

Item 1.2f. The apparatus of item 1.2e, wherein the guide assembly further includes a lever pivotably attached to the frame and coupled to the moveable member by one or more springs.

Item 1.2g. The apparatus of item 1.2, wherein the second bearing includes a roller plate attached thereto, the roller plate having a greater diameter than that of the second bearing.

Item 1.2h. The apparatus of item 1.2, wherein the frame includes parallel first and second frame members, and wherein the guide assembly is mounted between the first and second frame members.

Item 1.2i. The apparatus of item 1.2, further comprising:

a first guide roller attached to the frame in substantial alignment with the guide assembly such that the first guide roller contacts a top surface of the given support beam when the guide assembly engages the given support beam.

Item 1.2j. The apparatus of item 1.2i, further comprising:

a second guide roller and a third guide roller attached to the frame at different positions than the first guide roller, the second and third guide rollers configured to contact respective second and third support beams when the first guide roller contacts the given support beam.

Item 1.2k. The apparatus of item 1.2, further comprising:

a first magnetic brake assembly attached to the frame, the first magnetic brake assembly having a first magnetic element moveable between a locked position and an unlocked position.

Item 1.2L. The apparatus of item 1.2, wherein the first hub is part of a hub brake, the hub brake having a locked position in which the first hub resists rotational motion and an unlocked position in which the first hub freely moves.

Item 1.2m. The apparatus of item 1.2L, further comprising:

a first magnetic brake assembly attached to the frame, the first magnetic brake assembly having a first magnetic element moveable between a locked position and an unlocked position; and a control bar attached to the frame;

wherein the control bar is coupled to both the hub brake and the first magnetic brake in such a manner that a motion of the control bar causes the hub brake to shift between the unlocked position and the locked position and the first magnetic element to shift between the unlocked position and the locked position.

Item 1.2n. A method of draping a fall protection fabric over a plurality of spaced support beams on a rooftop to cover gaps between such support beams, the method comprising: providing a roll of the fabric, the roll having a first end and a second end;

providing the dispensing apparatus of item 1.2;

securing the first end of the roll to the first hub and securing the second end of the roll to the second hub;

dispensing a first portion and a second portion of the fabric by unwinding the roll, the first portion being connected to the roll by the second portion;

securing the first portion of the fabric to the rooftop by sandwiching the first portion of the fabric between the support beams and one or more roof panels;

positioning the dispensing apparatus on the rooftop such that the second portion of the fabric overlays the support beams in a region devoid of any roof panels; and holding the second portion of the fabric in place at least in part by engaging the given support beam with the guide assembly.

Item 1.3 A method of providing fall protection on a rooftop that includes a plurality of spaced support beams, the method comprising:

providing a roll of fabric, the roll having a first end and a second end;

providing a dispensing apparatus having a frame, a first and second hub attached to the frame, and a guide assembly attached to the frame, the guide assembly including a first and second bearing disposed beneath the frame and configured to engage opposite sides of a given support beam, the first and second bearings each having a central axis of rotation, the guide assembly being configured to allow linear motion of the frame along the given support beam in a first direction but resist linear motion of the frame along the given support beam in a second direction opposite to the first direction;

placing the first end of the roll on the first hub and placing the second end of the roll on the second hub;

dispensing a continuous length of the fabric by unwinding the roll, the continuous length including a first portion and a second portion;

securing the first portion of the fabric to the rooftop by sandwiching it between the support beams and one or more roof panels;

positioning the dispensing apparatus on the rooftop such that the second portion of the fabric, disposed between the first portion and the roll, overlays the support beams in a region devoid of any roof panels; and holding the second portion of the fabric in place at least in part by engaging the given support beam with the guide assembly.

Item 1.3a. The method of item 1.3, wherein at least one of the first and second bearings is configured to rotate in only one rotational direction.

Item 1.3b. The method of item 1.3, wherein the dispensing apparatus further includes a first magnetic brake assembly attached to the frame, the first magnetic brake assembly having a locked position and an unlocked position, and wherein the holding the second portion of the fabric in place is accomplished at least in part by the first magnetic brake assembly being in the locked position.

Item 1.3c. The method of item 1.3b, wherein the first magnetic brake assembly in the locked position engages a second one of the support beams different from the given support beam.

Item 1.3d. The method of item 1.3, wherein the first hub is part of a hub brake, the hub brake having a locked position in which the first hub resists rotational motion and an unlocked position in which the first hub freely moves, and wherein the holding the second portion of the fabric in place is accomplished at least in part by the hub brake being in the locked position.

Item 1.3e. The method of item 1.3, wherein the dispensing apparatus further includes a first magnetic brake assembly attached to the frame, the first magnetic brake assembly having a locked position and an unlocked position, and wherein the first hub is part of a hub brake, the hub brake having a locked position in which the first hub resists rotational motion and an unlocked position in which the first hub freely moves, and wherein the holding the second portion of the fabric in place is accomplished at least in part by the first magnetic brake assembly being in the locked position and by the hub brake being in the locked position.

Item 1.3f. The method of item 1.3e, wherein the dispensing apparatus includes a control bar coupled to the first magnetic brake assembly and to the hub brake, and wherein a motion of the control bar shifts the first magnetic brake to the locked position and shifts the hub brake to the locked position.

Item 2.1. An apparatus for dispensing a rolled fabric over spaced support beams on a rooftop, comprising:

a frame;

a first and second hub attached to opposite ends of the frame and configured to receive a roll of the rolled fabric; and a first magnetic brake assembly attached to the frame, the first magnetic brake assembly having a first magnetic element moveable between a first locked position and a first unlocked position;

wherein in the first locked position the first magnetic element is configured to contact a first support beam to resist motion of the frame along the first support beam, and wherein in the first unlocked position the first magnetic element is configured to be spaced apart from the first support beam to allow motion of the frame along the first support beam.

Item 2.1a. The apparatus of item 2.1, further comprising:

a second magnetic brake assembly attached to the frame, the second magnetic brake assembly having a second magnetic element moveable between a second locked position and a second unlocked position;

wherein in the second locked position the second magnetic element is configured to contact a second support beam to resist motion of the frame along the second support beam, and wherein in the second unlocked position the second magnetic element is configured to be spaced apart from the second support beam to allow motion of the frame along the second support beam.

Item 2.1b. The apparatus of item 2.1a, further comprising:

a control bar rotatably mounted to the frame;

wherein the first magnetic brake assembly includes a first magnet control arm attached to the control bar, and the second magnetic brake assembly includes a second magnet control arm attached to the control bar, such that rotating the control bar shifts the first magnetic brake assembly from the first locked position to the first unlocked position, and shifts the second magnetic brake assembly from the second locked position to the second unlocked position.

Item 2.1c. The apparatus of item 2.1, further comprising:

a control bar moveably mounted to the frame;

wherein the first magnetic brake assembly includes a first magnet control arm attached to the control bar, such that shifting the first magnetic brake assembly from the locked position to the unlocked position or vice versa is accomplished by moving the control bar.

Item 2.1d. The apparatus of item 2.1c, wherein the control bar is rotatably mounted to the frame, and shifting the first magnetic brake assembly from the first locked position to the first unlocked position and vice versa is accomplished by rotating the control bar.

Item 2.1e. The apparatus of item 2.1, wherein the first magnetic brake assembly includes a first pivot arm pivotably attached to the frame, and the first magnetic element is mounted to the pivot arm.

Item 2.1f. The apparatus of item 2.1, further comprising:

a first guide roller attached to the frame in substantial alignment with the first magnetic brake assembly such that the first guide roller contacts a top surface of the first support beam when the first magnetic element contacts the first support beam in the first locked position.

Item 2.1g. The apparatus of item 2.1, wherein the frame includes parallel first and second frame members, and wherein the first magnetic brake assembly is mounted between the first and second frame members.

Item 2.1h. The apparatus of item 2.1, wherein the first hub is part of a hub brake, the hub brake having a locked position in which the first hub resists rotational motion and an unlocked position in which the first hub freely moves.

Item 2.1i. The apparatus of item 2.1h, further comprising:

a control bar moveably mounted to the frame;

wherein the control bar mechanically couples to both the first magnetic brake assembly and the hub brake such that movement of the control bar shifts the first magnetic brake assembly between the first locked position and the first unlocked position and shifts the hub brake between the locked position and the unlocked position.

Item 2.1j. The apparatus of item 2.1i, further comprising:

a second magnetic brake assembly attached to the frame, the second magnetic brake assembly having a second magnetic element moveable between a second locked position and a second unlocked position;

wherein the control bar is also mechanically coupled to the second magnetic brake assembly such that the movement of the control bar also shifts the second magnetic brake assembly between the second locked position and the second unlocked position.

Item 2.1k. The apparatus of item 2.1, further comprising:

a guide assembly attached to the frame, the guide assembly including a first and second bearing disposed beneath the frame and configured to engage a given support beam, the first and second bearings each having a central axis of rotation.

Item 2.1L. The apparatus of item 2.1, further comprising:

a guide assembly attached to the frame, the guide assembly being configured to allow linear motion of the frame along a given support beam in a first direction but resist linear motion of the frame along the given support beam in a second direction opposite to the first direction.

Item 2.2. An apparatus for dispensing a rolled fabric over spaced support beams on a rooftop, comprising:

a frame;

a first and second hub attached to the frame and configured to receive opposite ends of a roll of the rolled fabric;

a first magnetic brake assembly attached to the frame and having a first locked position, in which the first magnetic brake assembly magnetically attaches to a first one of the support beams, and a first unlocked position, in which the first magnetic brake assembly does not magnetically attach to the first support beam;

a second magnetic brake assembly attached to the frame and having a second locked position, in which the second magnetic brake assembly magnetically attaches to a second one of the support beams, and a second unlocked position, in which the second magnetic brake assembly does not magnetically attach to the second support beam; and a control bar moveably mounted to the frame;

wherein the control bar is mechanically coupled to both the first magnetic brake assembly and the second magnetic brake assembly such that shifting of the first magnetic brake assembly between the first locked position and the first unlocked position, and shifting of the second magnetic brake assembly between the second locked position and the second unlocked position, is accomplished by movement of the control bar.

Item 2.2a. The apparatus of item 2.2, wherein the first magnetic brake assembly includes a first magnetic element, and wherein in the first locked position the first magnetic element is configured to contact the first support beam to resist motion of the frame, and wherein in the first unlocked position the first magnetic element is configured to be spaced apart from the first support beam to allow motion of the frame.

Item 2.2b. The apparatus of item 2.2a, wherein the first magnetic brake assembly includes a first pivot arm pivotably attached to the frame, and the first magnetic element is mounted to the pivot arm.

Item 2.2c. The apparatus of item 2.2, wherein the control bar is rotatably mounted to the frame, and wherein the shifting of the first magnetic brake assembly and the shifting of the second magnetic brake assembly is accomplished by rotating the control bar.

Item 2.2d. The apparatus of item 2.2, further comprising:

a first guide roller attached to the frame in substantial alignment with the first magnetic brake assembly such that the first guide roller contacts a top surface of the first support beam when the first magnetic brake assembly is positioned over the first support beam.

Item 2.2e. The apparatus of item 2.2d, further comprising:

a second guide roller attached to the frame in substantial alignment with the second magnetic brake assembly such that the second guide roller contacts a top surface of the second support beam when the first magnetic brake assembly is positioned over the first support beam.

Item 2.2f. The apparatus of item 2.2, wherein the frame includes parallel first and second frame members, and wherein the first magnetic brake assembly is mounted between the first and second frame members.

Item 2.2g. The apparatus of item 2.2, wherein the first hub is part of a hub brake, the hub brake having a locked position in which the first hub resists rotational motion and an unlocked position in which the first hub freely moves.

Item 2.2h. The apparatus of item 2.2g, wherein the control bar also mechanically couples to the hub brake, and wherein the movement of the control bar also shifts the hub brake between the locked position and the unlocked position.

Item 2.2i. The apparatus of item 2.2, further comprising:

a guide assembly attached to the frame, the guide assembly including a first and second bearing disposed beneath the frame and configured to engage a given support beam.

Item 2.2j. The apparatus of item 2.2, further comprising:

a guide assembly attached to the frame, the guide assembly being configured to allow linear motion of the frame along a given support beam in a first direction but resist linear motion of the frame along the given support beam in a second direction opposite to the first direction.

Item 2.3. A method of providing fall protection on a rooftop that includes a plurality of spaced support beams, the method comprising:

providing a roll of fabric, the roll having a first end and a second end;

providing a dispensing apparatus having a frame, a first and second hub attached to the frame, and a first magnetic brake assembly attached to the frame and having a first locked position, in which the first magnetic brake assembly magnetically attaches to a first support beam to resist motion of the frame along the first support beam, and a first unlocked position, in which the first magnetic brake assembly does not magnetically attach to the first support beam;

placing the first end of the roll on the first hub and placing the second end of the roll on the second hub;

dispensing a continuous length of the fabric by unwinding the roll, the continuous length including a first portion and a second portion;

securing the first portion of the fabric to the rooftop by sandwiching it between the support beams and one or more roof panels;

positioning the dispensing apparatus on the rooftop such that the second portion of the fabric, disposed between the first portion and the roll, overlays the support beams in a region devoid of any roof panels; and holding the second portion of the fabric in place at least in part by placing the first magnetic brake assembly in the first locked position.

Item 2.3a. The method of item 2.3, wherein the dispensing apparatus includes a control bar coupled to the first magnetic brake assembly, and wherein the placing the first magnetic brake assembly in the first locked position includes moving the control bar.

Item 2.3b. The method of item 2.3a, wherein the control bar is rotatably mounted to the frame, and the moving the control bar comprises rotating the control bar.

Item 2.3c. The method of item 2.3a, wherein the first magnetic brake assembly includes a first magnetic element attached to a first pivot arm, and the moving the control bar causes the first pivot arm to pivot.

Item 2.3d. The method of item 2.3a, wherein the dispensing apparatus also includes a second magnetic brake assembly having a second locked position and a second unlocked position, and the moving the control bar also places the second magnetic brake assembly in the second locked position.

Item 2.3e. The method of item 2.3a, wherein the dispensing apparatus also includes a hub brake having a locked position and an unlocked position, and the moving the control bar places the hub brake in the locked position.

Item 3.1. An apparatus for dispensing a rolled fabric over spaced support beams on a rooftop, comprising:

a frame; and a first and second hub attached to the frame and configured to receive opposite ends of a roll of the rolled fabric;

wherein the first hub is part of a hub brake, the hub brake having a locked position in which the first hub resists rotational motion and an unlocked position in which the first hub freely rotates.

Item 3.1a. The apparatus of item 3.1, wherein the hub brake comprises a hub assembly and a rack arm, the hub assembly including the first hub and a hub gear fixed to the first hub, and wherein the rack arm engages the hub gear when the hub brake is in the locked position, and the rack arm does not engage the hub gear when the hub brake is in the unlocked position.

Item 3.1b. The apparatus of item 3.1a, wherein the hub assembly includes a pivot arm having a first end and a second end, the first hub being rotatably mounted to the pivot arm proximate the first end, the first hub having a hub axis of rotation, and the pivot arm pivoting about a pivot axis proximate the second end, the pivot axis being parallel to the hub axis of rotation.

Item 3.1c. The apparatus of item 3.1, wherein the first hub comprises an expansion hub configured to alternate between a contracted position and an expanded position.

Item 3.1d. The apparatus of item 3.1c, wherein the rolled fabric comprises a core around which the fabric is wound, and wherein in the contracted position of the expansion hub the core readily slips over the first hub, and in the expanded position of the expansion hub the first hub grips an inside surface of the core.

Item 3.1e. The apparatus of item 3.1c, wherein the expansion hub includes a central through bolt, and rotation of the through bolt causes the expansion hub to shift from the contracted position to the expanded position.

Item 3.1f. The apparatus of item 3.1c, wherein the expansion hub includes a hub core and a first locking key disposed in a first slot in the hub core, the first locking key and the hub core being in sliding engagement with each other to permit the first locking key to alternately retract into and extend out of the first slot.

Item 3.1g. The apparatus of item 3.1 f, wherein the first slot is one of a plurality of slots in the hub core, and the first locking key is one of a plurality of locking keys corresponding to the plurality of slots.

Item 3.1h. The apparatus of item 3.1c, wherein the expansion hub includes a hub core and a first locking key configured to alternately retract into and extend out of a first slot in the hub core, wherein the hub core has a hub axis of rotation, and wherein the locking key has a ridged end, the ridge extending along an axis that is parallel to the hub axis of rotation.

Item 3.1i. The apparatus of item 3.1, further comprising:

a control bar moveably mounted to the frame and mechanically coupled to the hub brake;

wherein shifting of the hub brake between the locked position and the unlocked position is accomplished by movement of the control bar.

Item 3.1j. The apparatus of item 3.1i, further comprising:

a magnetic brake assembly attached to the frame and having a first locked position, in which the magnetic brake assembly magnetically attaches to a first support beam to resist motion of the frame along the first support beam, and a first unlocked position, in which the magnetic brake assembly does not magnetically attach to the first support beam;

wherein the control bar is also mechanically coupled to the magnetic brake, such that the movement of the control bar also shifts the magnetic brake assembly between the first locked position and the first unlocked position.

Item 3.1k. The apparatus of item 3.1, further comprising:

a guide assembly attached to the frame, the guide assembly including a first and second bearing disposed beneath the frame and configured to engage a given support beam, the first and second bearings each having a central axis of rotation.

Item 3.1L. The apparatus of item 3.1, further comprising:

a guide assembly attached to the frame, the guide assembly being configured to allow linear motion of the frame along a given support beam in a first direction but resist linear motion of the frame along the given support beam in a second direction opposite to the first direction.

Item 3.2. An apparatus for dispensing a rolled fabric over spaced support beams on a rooftop, comprising:

a frame; and a first and second hub attached to the frame and configured to receive opposite ends of a roll of the rolled fabric;

wherein the first hub is an expansion hub configured to alternate between a contracted position and an expanded position.

Item 3.2a. The apparatus of item 3.2, wherein the rolled fabric comprises a core around which the fabric is wound, and wherein in the contracted position of the expansion hub the core readily slips over the first hub, and in the expanded position of the expansion hub the first hub grips an inside surface of the core.

Item 3.2b. The apparatus of item 3.2, wherein the expansion hub includes a central through bolt, and rotation of the through bolt causes the expansion hub to shift from the contracted position to the expanded position.

Item 3.2c. The apparatus of item 3.2, wherein the expansion hub includes a hub core and a first locking key disposed in a first slot in the hub core, the first locking key and the hub core being in sliding engagement with each other to permit the first locking key to alternately retract into and extend out of the first slot.

Item 3.2d. The apparatus of item 3.2c, wherein the first slot is one of a plurality of slots in the hub core, and the first locking key is one of a plurality of locking keys corresponding to the plurality of slots.

Item 3.2e. The apparatus of item 3.2c, wherein the first locking key has a ridged end, the ridge extending along an axis that is parallel to an axis of rotation of the expansion hub.

Item 3.2f. The apparatus of item 3.2, wherein the expansion hub is part of a hub assembly which in turn is part of a hub brake, the hub brake having a locked position in which the expansion hub resists rotational motion and an unlocked position in which the expansion hub freely rotates.

Item 3.2g. The apparatus of item 3.2f, wherein the hub brake comprises the hub assembly and a rack arm, the hub assembly including the expansion hub and a hub gear fixed to the expansion hub, and wherein the rack arm engages the hub gear when the hub brake is in the locked position, and the rack arm does not engage the hub gear when the hub brake is in the unlocked position.

Item 3.2h. The apparatus of item 3.2f, wherein the hub assembly includes a pivot arm having a first end and a second end, the expansion hub being rotatably mounted to the pivot arm proximate the first end, the expansion hub having a hub axis of rotation, and the pivot arm pivoting about a pivot axis proximate the second end, the pivot axis being parallel to the hub axis of rotation.

Item 3.3. A method of providing fall protection on a rooftop that includes a plurality of spaced support beams, the method comprising:

providing a roll of fabric, the roll having a first end and a second end;

providing a dispensing apparatus having a frame, a first and second hub attached to the frame, and a hub brake that includes the first hub, the hub brake having a locked position in which the first hub resists rotational motion and an unlocked position in which the first hub freely rotates;

placing the first end of the roll on the first hub and placing the second end of the roll on the second hub;

dispensing a continuous length of the fabric by unwinding the roll, the continuous length including a first portion and a second portion;

securing the first portion of the fabric to the rooftop by sandwiching it between the support beams and one or more roof panels;

positioning the dispensing apparatus on the rooftop such that the second portion of the fabric, disposed between the first portion and the roll, overlays the support beams in a region devoid of any roof panels; and holding the second portion of the fabric in place at least in part by placing the hub brake in the locked position.

Item 3.3a. The method of item 3.3, wherein the first hub comprises an expansion hub configured to alternate between a contracted position and an expanded position, the method further comprising:

placing the expansion hub in the expanded position by turning a bolt axially positioned through the expansion hub.

Item 3.3b. The method of item 3.3, wherein the dispensing apparatus includes a control bar coupled to the hub brake, and wherein the placing the hub brake in the locked position includes moving the control bar.

Item 3.3c. The method of item 3.3b, wherein the dispensing apparatus also includes a magnetic brake assembly having a locked position and an unlocked position, and wherein the control bar also couples to the magnetic brake assembly, and wherein the moving the control bar also places the magnetic brake assembly in the locked position.

Item 3.3d. The method of item 3.3, wherein the dispensing apparatus also includes a guide assembly attached to the frame, the guide assembly being configured to allow linear motion of the frame along a given support beam in a first direction but resist linear motion of the frame along the given support beam in a second direction opposite to the first direction.

Various modifications and alterations of this invention will be apparent to those skilled in the art without departing from the spirit and scope of this invention, which is not limited to the illustrative embodiments set forth herein. The reader should assume that features of one disclosed embodiment can also be applied to all other disclosed embodiments unless otherwise indicated. All U.S. patents, patent application publications, and other patent and non-patent documents referred to herein are incorporated by reference, to the extent they do not contradict the foregoing disclosure.

What is claimed is:

1. An apparatus for dispensing a rolled fabric over spaced support beams on a rooftop, comprising:

a frame; and a first and second hub attached to the frame and configured to receive opposite ends of a roll of the rolled fabric;

wherein the first hub is part of a hub brake, the hub brake having a locked position in which the first hub resists rotational motion and an unlocked position in which the first hub freely rotates; and wherein the hub brake comprises a hub assembly and a rack arm, the hub assembly including the first hub and a hub gear fixed to the first hub, and wherein the rack arm engages the hub gear when the hub brake is in the locked position, and the rack arm does not engage the hub gear when the hub brake is in the unlocked position.

2. The apparatus of claim 1, wherein the hub assembly includes a pivot arm having a first end and a second end, the first hub being rotatably mounted to the pivot atm proximate the first end, the first hub having a hub axis of rotation, and the pivot arm pivoting about a pivot axis proximate the second end, the pivot axis being parallel to the hub axis of rotation.

3. An apparatus for dispensing a rolled fabric over spaced support beams on a rooftop, comprising:

a frame;

a first and second hub attached to the frame and configured to receive opposite ends of a roll of the rolled fabric, the first hub being part of a hub brake, the hub brake having a locked position in which the first hub resists rotational motion and an unlocked position in which the first hub freely rotates;

a control bar moveably mounted to the frame and mechanically coupled to the hub brake; and a magnetic brake assembly attached to the frame and having a first locked position, in which the magnetic brake assembly magnetically attaches to a first support beam to resist motion of the frame along the first support beam, and a first unlocked position, in which the magnetic brake assembly does not magnetically attach to the first support beam;

wherein shifting of the hub brake between the locked position and the unlocked position is accomplished by movement of the control bar; and wherein the control bar is also mechanically coupled to the magnetic brake, such that the movement of the control bar also shifts the magnetic brake assembly between the first locked position and the first unlocked position.

4. An apparatus for dispensing a rolled fabric over spaced support beams on a rooftop, comprising:

a frame;

a first and second hub attached to the frame and configured to receive opposite ends of a roll of the rolled fabric; and a guide assembly attached to the frame, the guide assembly including a first and second bearing disposed beneath the frame and configured to engage a given support beam, the first and second bearings each having a central axis of rotation, the guide assembly being configured to allow linear motion of the frame along the given support beam in a first direction but resist linear motion of the frame along the given support beam in a second direction opposite to the first direction;

wherein the first hub is part of a hub brake, the hub brake having a locked position in which the first hub resists rotational motion and an unlocked position in which the first hub freely rotates.

5. An apparatus for dispensing a rolled fabric over spaced support beams on a rooftop, comprising:

a frame; and a first and second hub attached to the frame and configured to receive opposite ends of a roll of the rolled fabric;

wherein the first hub is an expansion hub configured to alternate between a contracted position and an expanded position; and wherein the expansion hub is part of a hub assembly which in turn is part of a hub brake, the hub brake having a locked position in which the expansion hub resists rotational motion and an unlocked position in which the expansion hub freely rotates.

6. The apparatus of claim 5, wherein the hub brake comprises the hub assembly and a rack arm, the hub assembly including the expansion hub and a hub gear fixed to the expansion hub, and wherein the rack arm engages the hub gear when the hub brake is in the locked position, and the rack arm does not engage the hub gear when the hub brake is in the unlocked position.

7. The apparatus of claim 5, wherein the hub assembly includes a pivot arm having a first end and a second end, the expansion hub being rotatably mounted to the pivot arm proximate the first end, the expansion hub having a hub axis of rotation, and the pivot arm pivoting about a pivot axis proximate the second end, the pivot axis being parallel to the hub axis of rotation.

* * * * *